US007430783B2

(12) United States Patent
Williams et al.

(10) Patent No.: US 7,430,783 B2
(45) Date of Patent: Oct. 7, 2008

(54) TANK LATCHING ARRANGEMENT FOR A CLEANING APPARATUS

(75) Inventors: Jason L. Williams, Erie, PA (US); David J. Boles, Barberton, OH (US); Charles A. Lang, Hartville, OH (US); Richard S. Parr, Uniontown, OH (US); Ryan S. Steiner, Dalton, OH (US)

(73) Assignee: Healthy Gain Investment Limited, Tortola (BI)

( * ) Notice: Subject to any disclaimer, the term of this patent is extended or adjusted under 35 U.S.C. 154(b) by 952 days.

(21) Appl. No.: 10/877,448

(22) Filed: Jun. 25, 2004

(65) Prior Publication Data

US 2005/0283937 A1 Dec. 29, 2005

(51) Int. Cl.
*A47L 11/30* (2006.01)

(52) U.S. Cl. ..... 15/320; 15/321; 15/353

(58) Field of Classification Search ..... 15/320, 15/321, 331, 334, 353, 410; 55/DIG. 3
See application file for complete search history.

(56) References Cited

U.S. PATENT DOCUMENTS 4,934,019 A 6/1990 Shorthill et al.
5,406,673 A * 4/1995 Bradd et al. ..... 15/320
5,715,566 A 2/1998 Weaver et al.
5,836,046 A 11/1998 Huffman et al.
5,896,617 A * 4/1999 Kasen et al. ..... 15/320
5,901,408 A * 5/1999 Miller et al. ..... 15/339
6,378,162 B1 * 4/2002 Zahuranec et al. ..... 15/320
6,629,332 B2 10/2003 Morgan et al.
2005/0283936 A1 * 12/2005 Barker et al. ..... 15/320
2005/0283937 A1 * 12/2005 Williams et al. ..... 15/320
2005/0283938 A1 * 12/2005 Theiss et al. ..... 15/320
2005/0283939 A1 * 12/2005 Theiss et al. ..... 15/320
2005/0283941 A1 * 12/2005 Durbin et al. ..... 15/320

* cited by examiner

*Primary Examiner*—Lee D Wilson

(57) ABSTRACT

A cleaning apparatus for cleaning a surface in which cleaning solution is dispensed to the surface and substantially simultaneously extracted along with the dirt on the surface in a continuous operation is provided. In one aspect of the invention, the cleaning apparatus includes a housing and a recovery tank removably mounted to the housing. A solution tank for supplying a flow of cleaning solution to the surface is removably mounted to the housing. A suction nozzle is secured to the housing and is in fluid communication with the recovery tank. A suction source is in fluid communication with the suction nozzle for generating suction to draw dirt and liquid through the suction nozzle and into the recovery tank. A first latch is operatively connected to the solution tank to releasably latch the solution tank to the housing and a second latch is operatively connected to the recovery tank to releasably latch the recovery tank to said housing, wherein the second latch is in close proximity to the first latch.

19 Claims, 31 Drawing Sheets

TANK LATCHING ARRANGEMENT FOR A CLEANING APPARATUS

BACKGROUND OF THE INVENTION

1. Field of the Invention

The present invention relates to a tank latching arrangement for a cleaning apparatus.

2. Background Information

It is known to have a carpet extractor for cleaning a surface such as a carpet in which cleaning solution is dispensed to the surface and substantially simultaneously extracted along with the dirt on the surface into a recovery tank in a continuous operation. Generally, the carpet extractor includes a solution tank along with the recovery tank that are both removably mounted to the extractor. Latches are incorporated to releasably hold these tanks to the extractor. Often, the latches are operated differently and are also located far apart from each other. This requires some inconvenience or difficulty by the user in locating each of them and also ascertaining as to how to operate each of them. Further, the often protruding latches detract from the overall appearance of the carpet extractor.

Hence, it is at least one object of the present invention to provide an improved cleaning apparatus that overcomes the above-mentioned problems, yet provides good cleaning performance.

SUMMARY OF THE INVENTION

The foregoing and other objects of the present invention will be readily apparent from the following description and the attached drawings. A cleaning apparatus for cleaning a surface in which cleaning solution is dispensed to the surface and substantially simultaneously extracted along with the dirt on the surface in a continuous operation is provided. The cleaning apparatus includes a housing and a recovery tank removably mounted to the housing. A solution tank for supplying a flow of cleaning solution to the surface is removably mounted to the housing. A suction nozzle is secured to the housing and is in fluid communication with the recovery tank. A suction source is in fluid communication with the suction nozzle for generating suction to draw dirt and liquid through the suction nozzle and into the recovery tank. A first latch is operatively connected to the solution tank to releasably latch the solution tank to the housing and a second latch is operatively connected to the recovery tank to releasably latch the recovery tank to the housing, wherein the second latch is in close proximity to the first latch.

In another aspect of the invention, a cleaning apparatus for cleaning a surface in which cleaning solution is dispensed to the surface and substantially simultaneously extracted along with the dirt on the surface in a continuous operation is provided. The cleaning apparatus includes a housing and a recovery tank removably mounted to the housing. A solution tank for supplying a flow of cleaning solution to the surface is removably mounted to the housing. A suction nozzle is secured to the housing and is in fluid communication with the recovery tank. A suction source is in fluid communication with the suction nozzle for generating suction to draw dirt and liquid through the suction nozzle and into the recovery tank. A latching assembly is operatively connected to the solution tank and the recovery tank to releasably latch the tanks to the housing. An actuator is operatively connected to the latch assembly for engagement by a user to selectively simultaneously unlatch both of the recovery tank and the solution tank from the housing.

In still another aspect of this invention, a cleaning apparatus for cleaning a surface in which cleaning solution is dispensed to the surface and substantially simultaneously extracted along with the dirt on the surface in a continuous operation is provided. The cleaning apparatus includes a housing having a front portion, a rear portion, and a pair of opposite side portions. The housing further includes a base portion for movement along the surface and a handle pivotally connected to the base portion. A solution tank for supplying a flow of cleaning solution to the surface is removably mounted to one of the side portions and a recovery tank is removably mounted to other one of the side portions. A suction nozzle is secured to the base portion and in fluid communication with the recovery tank. A suction source is in fluid communication with the suction nozzle for generating suction to draw dirt and liquid through the suction nozzle and into the recovery tank. A latch assembly is operatively connected to the housing and one of the solution and the recovery tanks for releasably latching the tank to the housing, wherein the latch assembly is positioned between the recovery and solution tanks.

BRIEF DESCRIPTION OF THE DRAWINGS

The invention will now be described, by way of example, with reference to the attached drawings, of which.

DETAILED DESCRIPTION OF THE INVENTION

Figure 1:
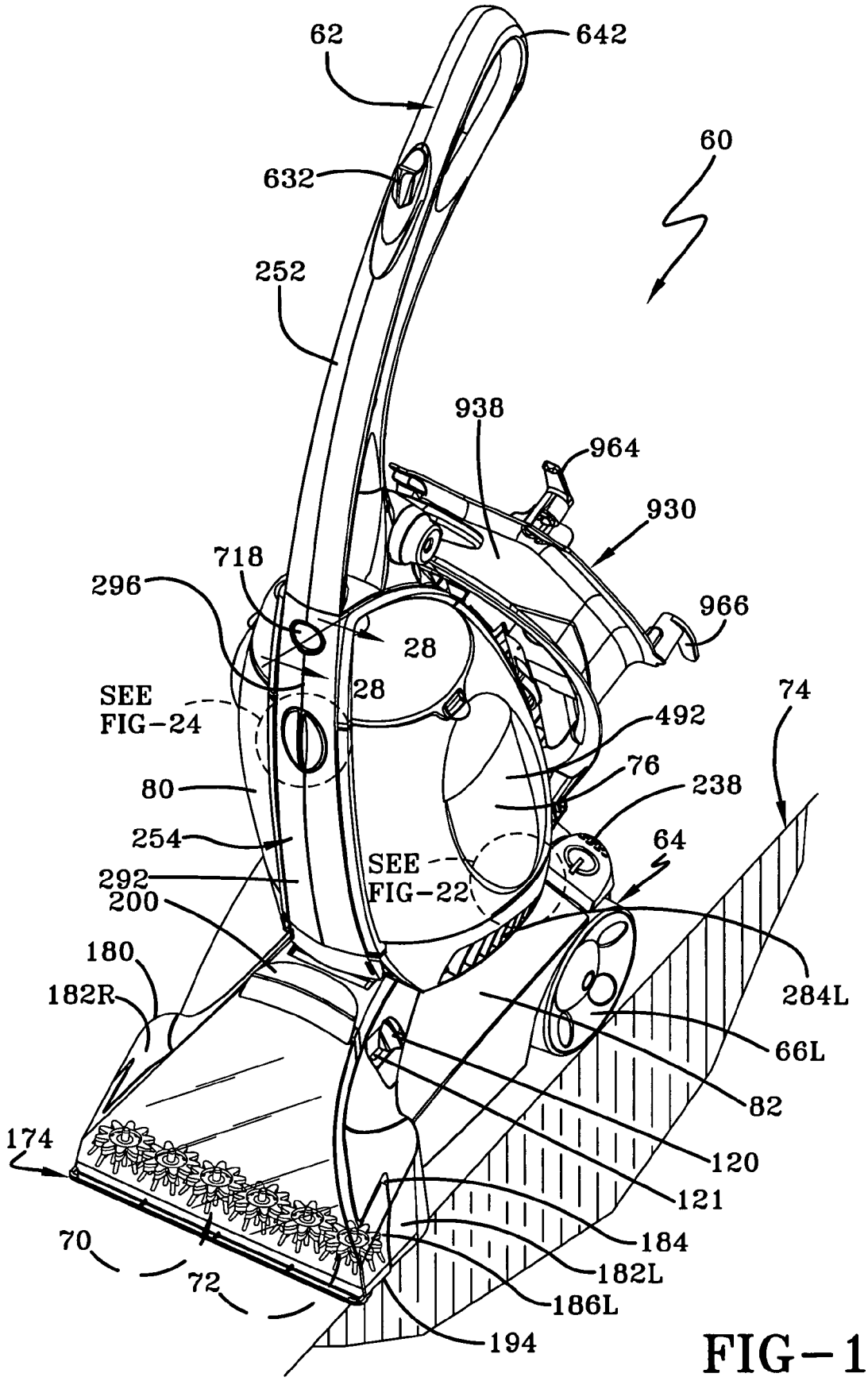
FIG. 1 is a perspective view of a carpet extractor embodying the present invention.

Referring to the drawings, FIG. 1 depicts a perspective view of an upright carpet extractor 60 according to one embodiment of the present invention. The upright carpet extractor 60 comprises an upright handle assembly 62 pivotally connected to the rear portion of the floor-engaging portion or base assembly 64 that moves and cleans along a surface 74 such as a carpet. The handle assembly 62 comprises an upper handle portion 252 pivotally connected to a lower handle body 254 so that the upper handle portion 252 can be folded rearwardly down to store the carpet extractor 60. The base assembly 64 includes a brush assembly 70 having a plurality of rotating scrub brushes 72 for scrubbing the surface. A supply or solution tank 76 for holding cleaning solution is removably mounted to the handle assembly 62 of the extractor 60. A combined air/water separator and recovery tank 80 is removably mounted to handle assembly 62 on the side opposite the solution tank 76.

Thus, the recovery and solution tanks 80, 76 are arranged in a side-by-side relationship. Both the recovery tank 80 and the solution tank 76 are moved in a transverse direction with respect to the cleaning path of the carpet extractor 60, when they are mounted to and removed from their respective sides of the handle assembly 62. Alternatively, the two tanks may be positioned in other ways such as a stacked arrangement, or nesting relationship in which one of the tanks is nested inside the other tank. Optionally, one tank having two compartments could be substituted for the two tanks.

Figure 2:
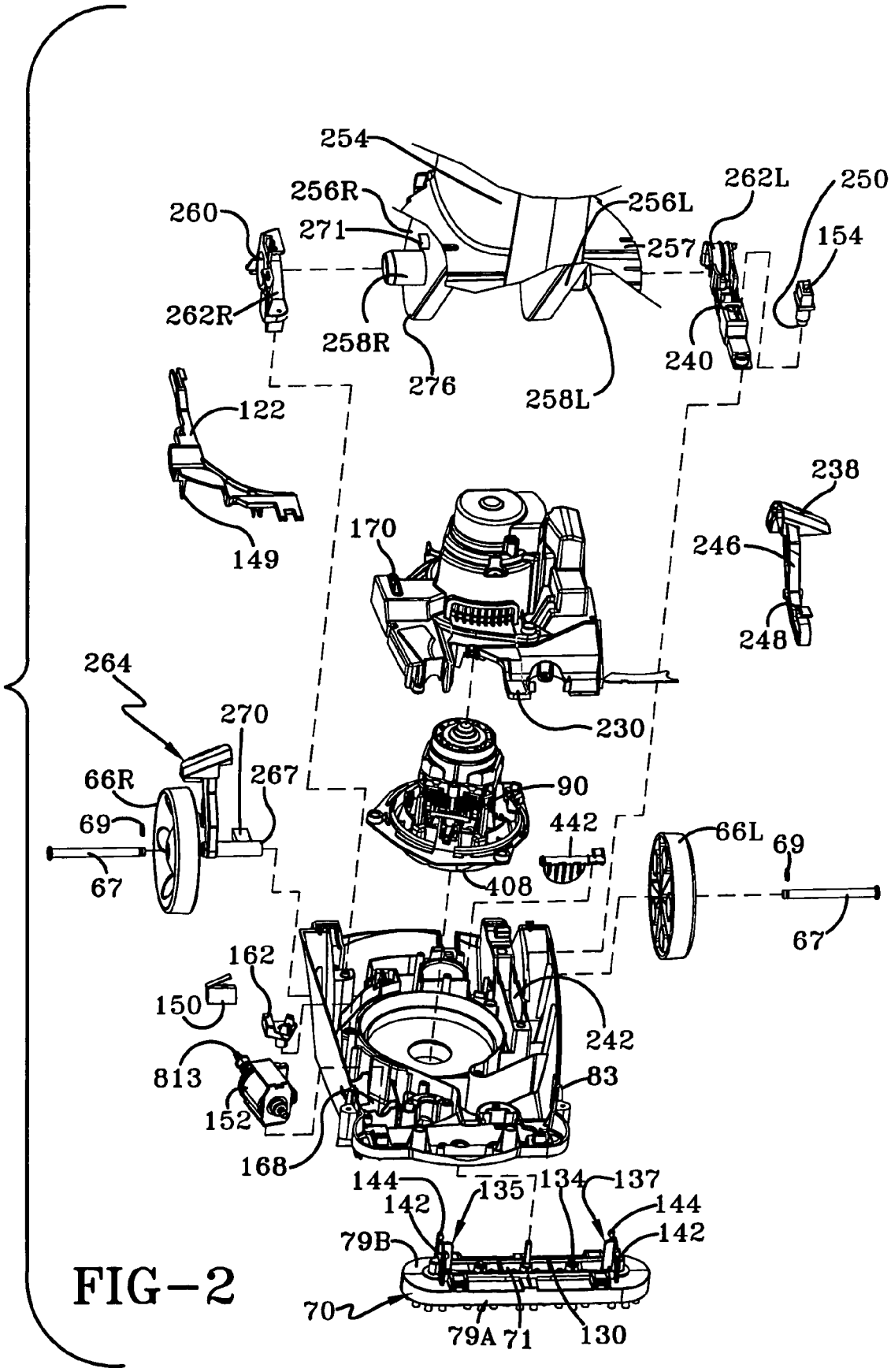
FIG. 2 is an exploded view of the lower portion of the base assembly and the lower portion of the handle with portions broken away therefrom of the carpet extractor of FIG. 1 illustrating the principle elements thereof.
Figure 3:
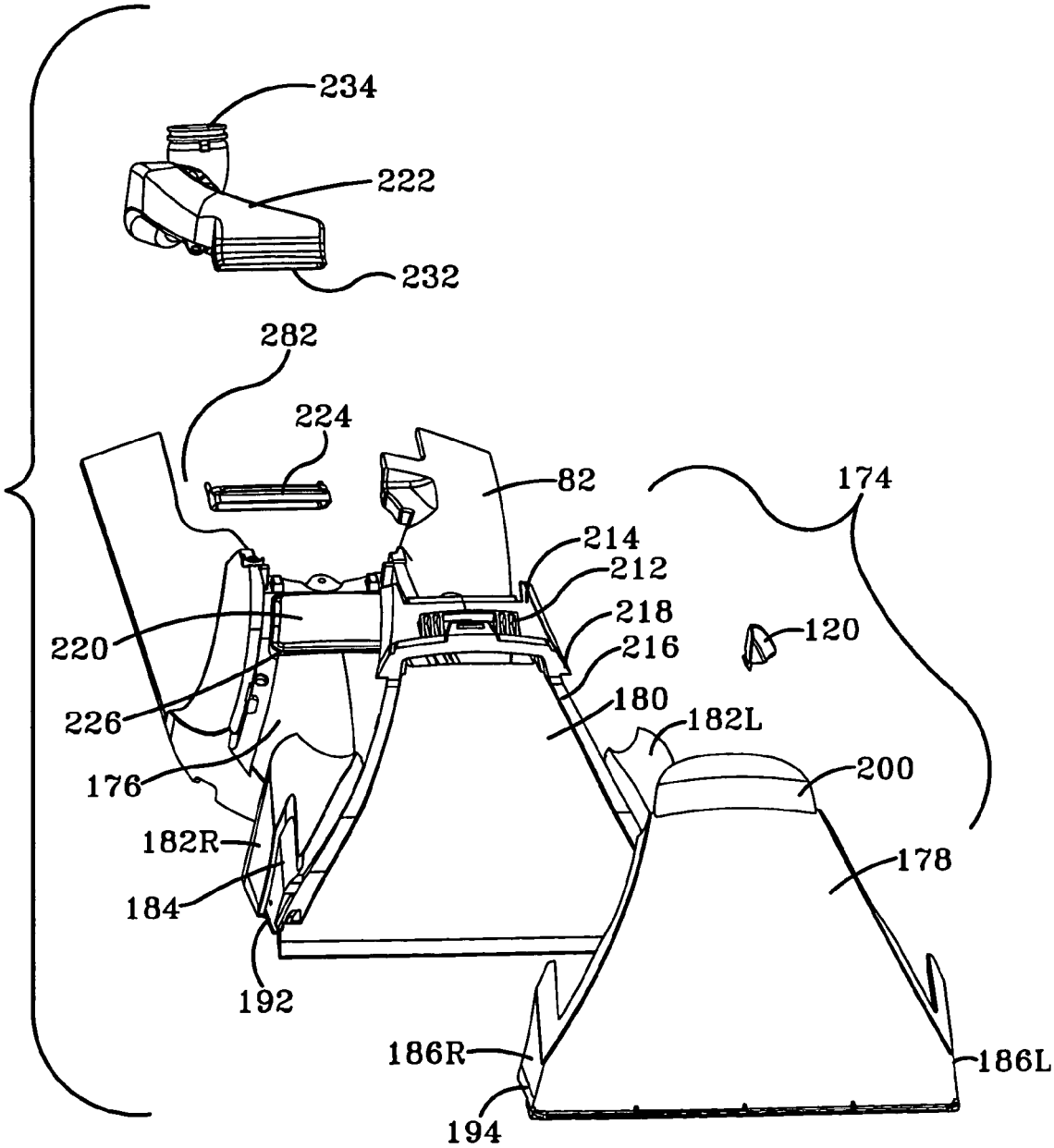
FIG. 3 is an exploded view of the upper portion of the base assembly illustrating the principal elements thereof.
Figure 5:
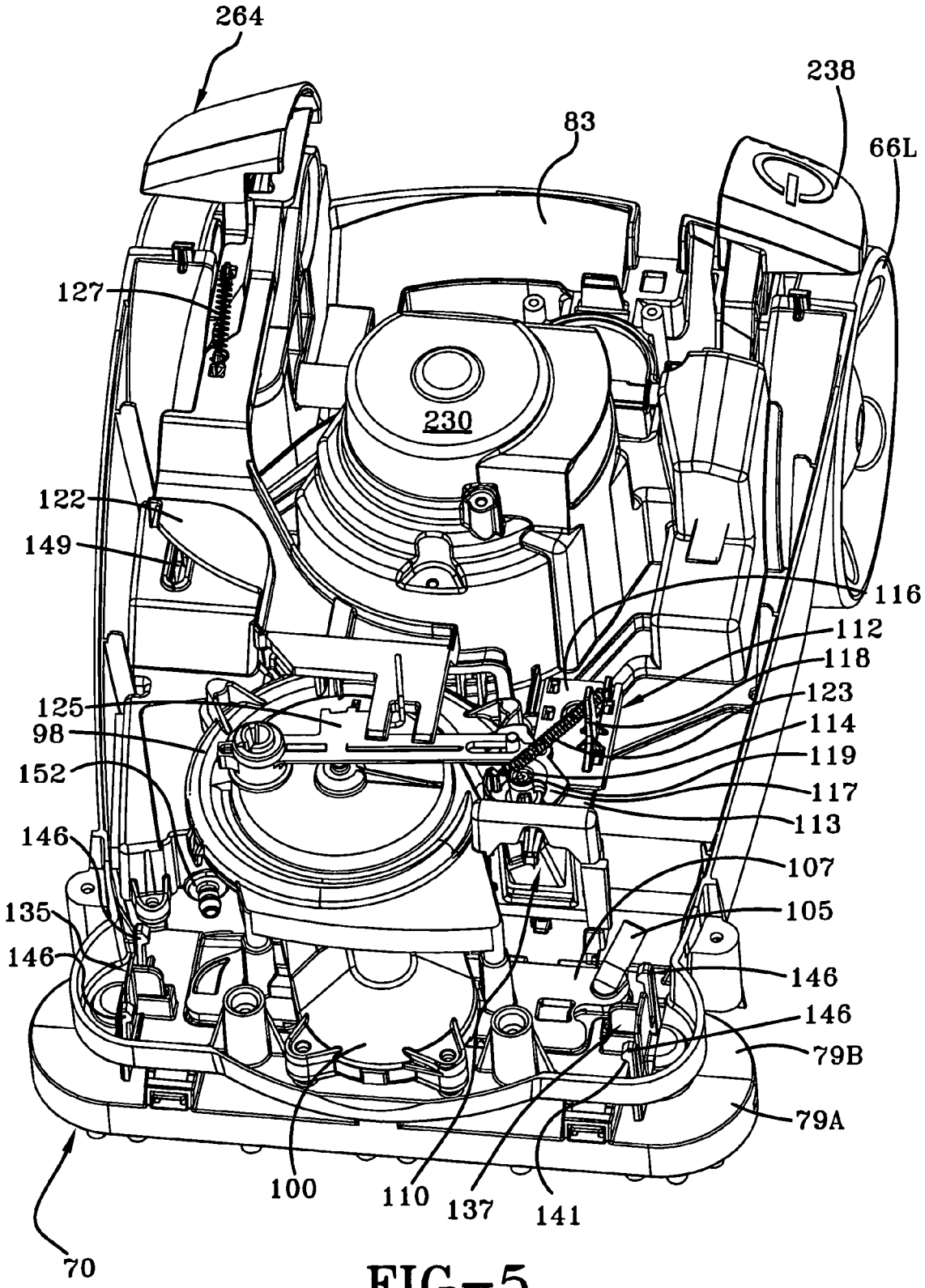
FIG. 5 is a perspective view of the lower portion of the base assembly of the carpet extractor of FIG. 1 illustrating the principle elements thereof.
Figure 8:
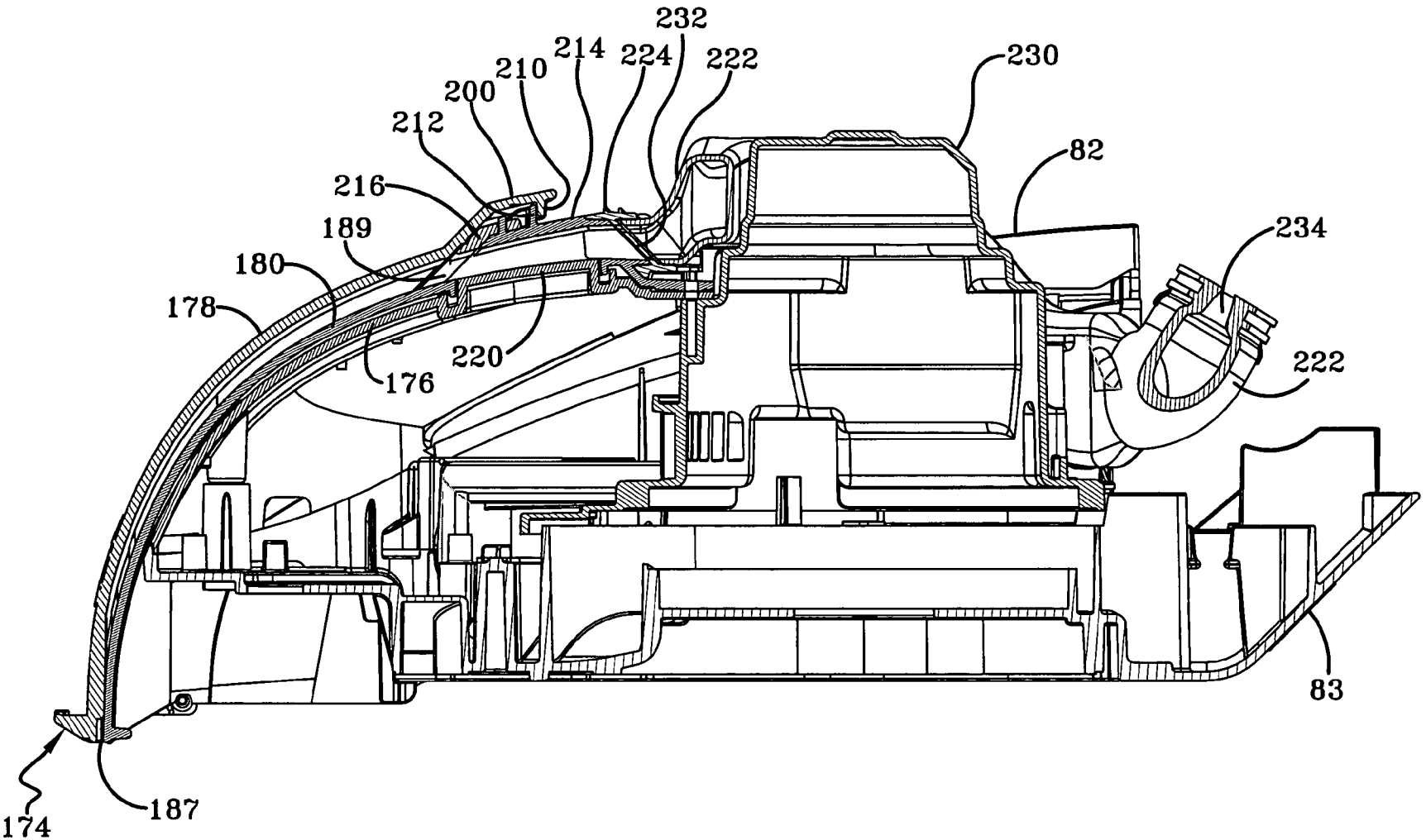
FIG. 8 is a partial side sectional view of the base assembly of the carpet extractor of FIG. 1, vertically taken through the center of the base assembly with the brush assembly and suction motor removed for illustrative purposes.
Figure 12:
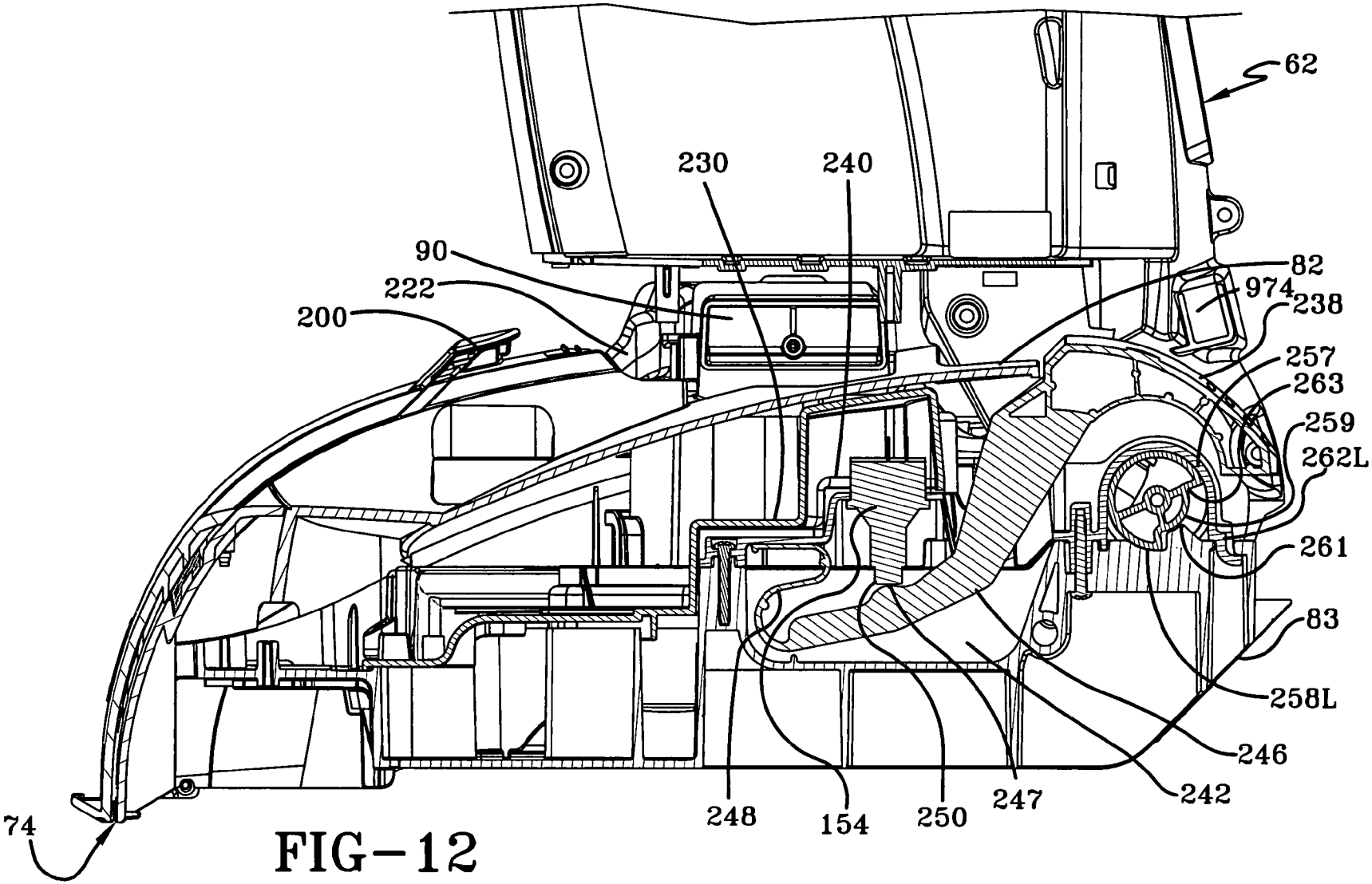
FIG. 12 is a partial sectional view taken along line 12-12 of FIG. 10 with the brush assembly removed.

As depicted in FIG. 2, the base assembly 64 includes a generally unitary molded base frame 83 having two laterally displaced wheels 66L, 66R rotatably attached to the rear of the base frame 83 via axles 67. An e-ring 69 is secured to each axle 67 to prevent inadvertent removal of the axle from the frame. Integrally molded into the bottom of the base frame 83 is a circular stepped basin 86 (FIG. 20) receiving therein the motor/fan assembly 90 with motor cover 230. A suitable motor/fan assembly is shown in U.S. Pat. No. 5,500,977, the disclosure of which is incorporated by reference. An air driven turbine 98 providing motive power for the brush assembly 70 is mounted on the front portion of the frame 83 as seen in FIG. 5. The base assembly 64 further includes an upper housing or hood portion 82 (FIGS. 1 and 3) mounted atop the base frame 83 and air driven turbine 98. The top portion of motor/fan assembly 90, motor cover 230 and floor recovery duct 222 (FIG. 3) extends through a cutout or opening 282 (FIG. 3) in the hood portion 82 as seen in FIGS. 8 and 12.

Figure 4:
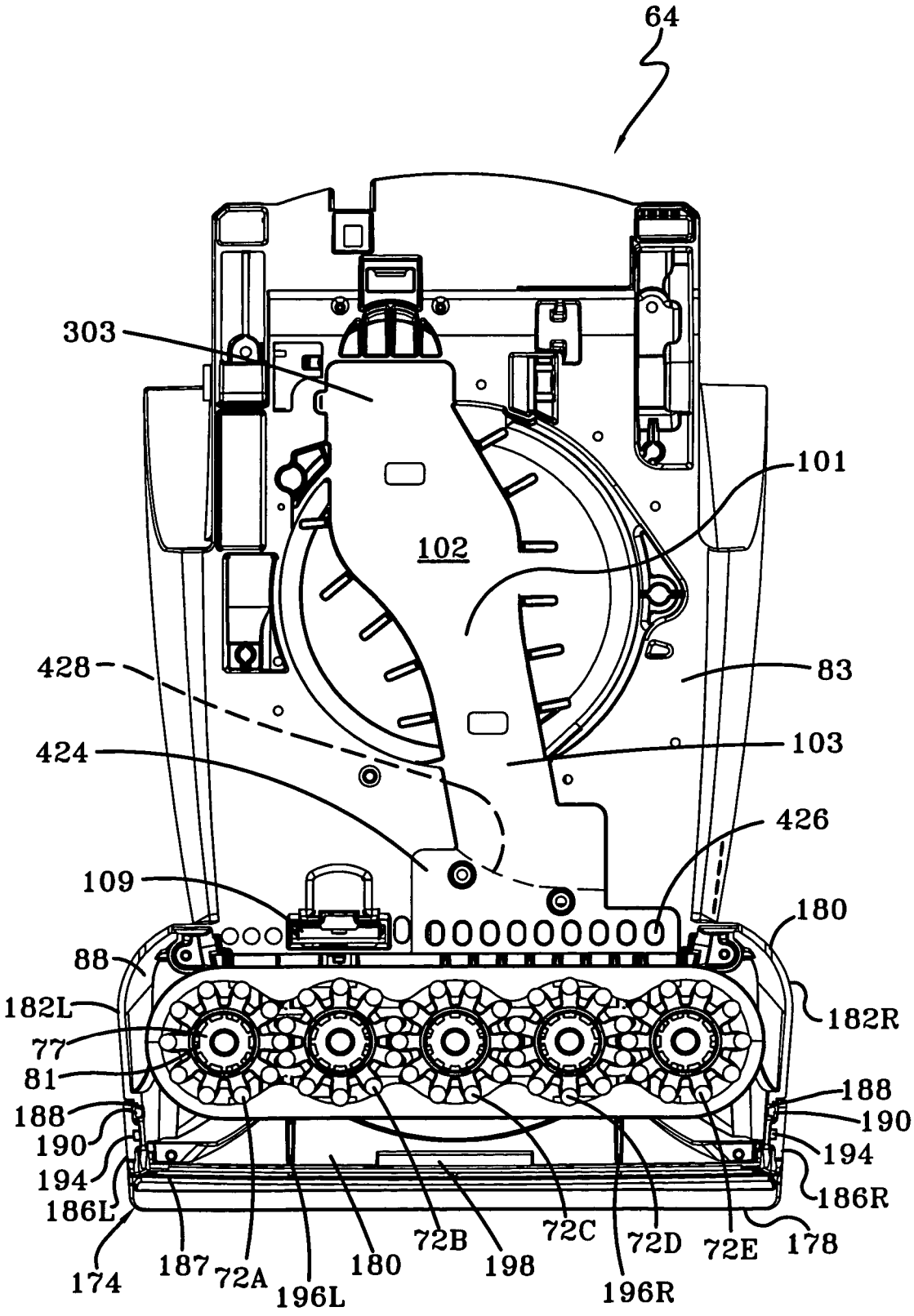
FIG. 4 is a bottom view of the base assembly of the extractor with the wheels removed for illustrative purposes.

As shown in FIGS. 2 and 4, the brush assembly 70 is contained in a brush assembly cavity 88 formed in the underside of the frame 83. The brush assembly 70 comprises a brush support beam 130 having five spaced apart integrally molded, cylindrical bearings 134. Rotatingly received within bearings are axial shafts (not shown but illustrated in previously mentioned U.S. Pat. No. 6,009,593; the disclosure of which is incorporated herein by reference) of gear brushes 72A, 72B, 72C, 72D, and 72E. The beam 130 further includes troughs 71, for receiving a cleaning solution. The cleaning solution flows through inlet 105 (FIG. 5) of distributor 107 (FIG. 5) to supply conduits of the beam 130 and then outward toward the surface being cleaned through openings 81 in the bottom of brush cups 77. Gear guards 79A and 79B are attached to the brush support beam 130 and are identical in construction so as to be interchangeable on either side of brush support beam 130.

Integral to and extending upward from the opposite lateral ends of brush support beam 130 are "T" shaped rails 135 and 137. As best seen in FIG. 5, T-rails 135 and 137 are slidably received within vertical guide slots 138 (FIG. 20) and 140 (FIG. 20) integrally molded into the lower base housing or frame 83 whereby brush assembly 70 may freely move or float in the vertical direction within the brush assembly cavity 88 of base assembly 64. Each T-rail includes front and rear hooks 142, 144 (FIG. 2) with inwardly extending noses 146 (FIG. 5) integrally molded on the upper portion of the hooks for removably mounting the brush assembly 70 to the frame 83. To mount the brush assembly 70 to frame 83, a user aligns the noses 146 of the hooks 142, 144 with the slots 138, 140 and pushes the brush assembly 70 towards the frame with sufficient force such that the noses 146 cam against the underside of the frame 83 at the inner edges of the slots 138,140 and deflect outwardly so that they can extend through the slots.

After extending through the slots 138,140, the resilient noses 146 deflect back and engage the top surface of the frame 83 to secure the brush assembly 70 to the frame 83, when the base assembly 64 is lifted off the surface 74.

Each nose 146 of the hook members 142, 144 has an upwardly beveled bottom side 141 (FIG. 5) going from the inner end to the outer end that aids in removing the brush assembly 70. In particular, to remove the brush assembly 70, a user pulls down on the brush assembly with sufficient force to cause frame 83 to cam against the bevel bottom sides 141 of the noses 146 so as to deflect the noses 146 outwardly a sufficient distance to allow the hooks 142, 144 to fall through the slots 138, 140. Alternatively, a user can simply apply a lateral outward force on the hooks 142, 144 to disengage them from the frame 83.

Such a suitable brush assembly 70 with the exception of the previously described hooks used to mount the brush assembly to the frame 83 is taught in U.S. Pat. No. 5,867,857, the disclosure which is incorporated herein by reference. Brush assembly 70 is operated by a suitable gear train (or other known means), not shown, contained in transmission housing 100 (FIG. 5). A suitable air turbine driven gear train is taught in U.S. Pat. No. 5,443,362, the disclosure of which is incorporated by reference. The brush assembly 70 can be a horizontal brush roll driven by a belt secured to the suction motor or driven by a separate motor.

Referring now to FIG. 4, integrally molded into the underside of the frame assembly 83 is a vacuum manifold 102. Manifold 102 is completed by welding a bottom plate 101 to the bottom of the frame 83. The manifold 102 includes a conduit 103 in fluid communication with the turbine 98 (FIG. 5) that provides a vacuum source for the turbine 98. The motor fan assembly 90 generally provides suction to the manifold 102 through the eye of the fan. Atmospheric air, driving a brush turbine rotor enters by way of turbine inlet 110 (FIG. 5), passing through a screen 109 to filter out the dirt and then passing through the rotor. Positioned within inlet 110 is a throttle valve door 114 (FIG. 5) for energizing or de-energizing brush turbine rotor. Such a suitable brush turbine 98 is disclosed in U.S. Pat. No. 5,860,188 which is hereby incorporated by reference.

Referring now to FIG. 5, a manual override mechanism 112 is provided whereby the operator, operating in the floor-cleaning mode, may selectively close throttle valve 114 thereby de-energizing brush drive turbine 98. Alternatively, the operator may select an intermediate position whereby throttle valve 114 is partially closed thereby reducing the air flow through throttle valve 114 causing brush drive turbine 98 to rotate at a slower speed resulting in slower rotating brushes. Override mechanism 112 comprises a table 113 integrally molded to the body of brush drive turbine 98 and extending rearwardly having slide 116 slidingly attached thereto. Extending upwardly from slide 116 is lever arm 118 having a conveniently shaped finger cap 120 (FIG. 1) atop thereof. Lever arm 118 extends upward through a suitable opening (not shown) in the hood 82 whereby cap 120 is received within recess 121 in hood 82 as seen in FIG. 1.

Movement of the cap 120 (FIG. 1) in turn moves the slide 118 to rotating a bell crank 117, which in turn rotates the shaft of the valve 114, attached thereto. In particular, projecting upward from slide 116 is an arcuate rib 119. As slide 116 is moved rearward by the operator, the rib 119 engages the bell crank 117 rotating the bell crank 117 and throttle valve 114 counterclockwise thereby closing throttle valve 114 and de-energizing the brush drive turbine 98. Upon return of the slide 116 to its original position (as illustrated in FIG. 5), a spring 123, secured between the bell crank 117 and the slide 116, causes the bell crank 117 to rotate clockwise, thereby rotating throttle valve 114 to the full open position. Generally as the slide 116 moves from one position to the other, a cantilevered tab releasingly engages concavities in the surface of the table, which corresponds to the open and close position of valve 114. A similar mechanism is disclosed in U.S. Pat. No. 5,860,188, the disclosure of which is incorporated by reference.

Figure 13A:
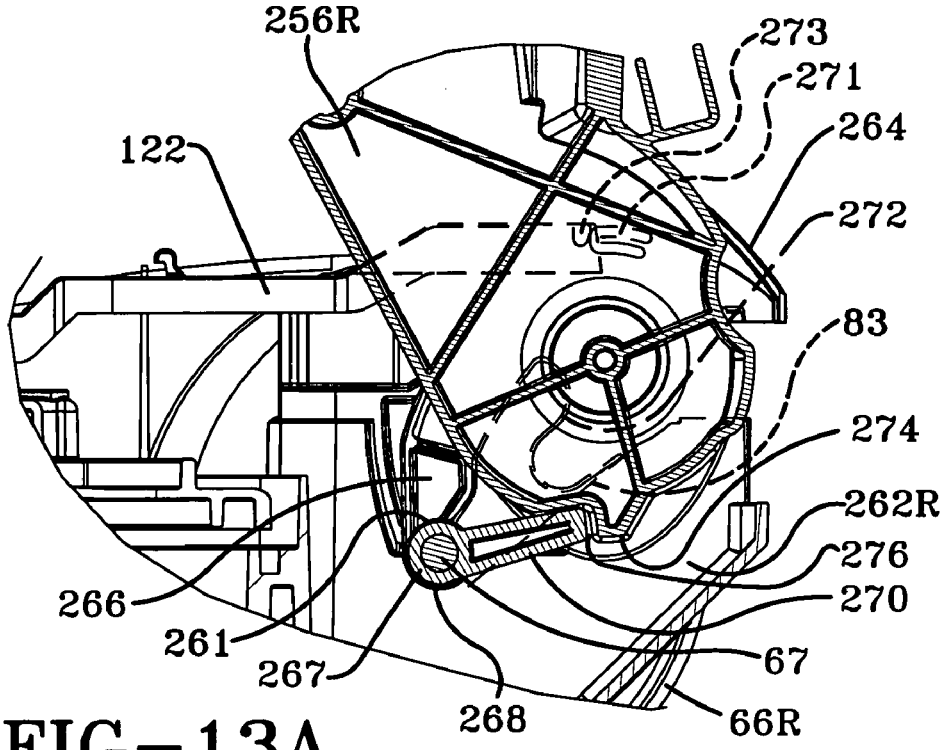
FIG. 13A is a partial sectional view taken along line 13A-13A of FIG. 11.

Further, when the handle assembly 62 is pivoted in the upright storage position, an actuating rod 122 links with the bell crank 117 via linking member 125 to turn the brushes off. In particular, as shown in FIG. 13A, a cam projection 271 formed on the outer surface of a right extension 256 of the handle assembly 62 cams against a rib 273 formed on the actuating rod 122 to cause the actuating rod 122 to close the throttle valve door 114 and turn the brushes off. However, when the handle assembly 62 is pivoted down to the incline working position, the cam projection 271 disengages from the rib 273, thereby allowing a spring 127, secured between the actuating rod 122 and trunnion bracket 262R, to urge the actuating rod 122 rearwardly to the position of FIG. 13B, which opens the throttle valve door 114 and turns on the brushes. Further details of this arrangement are disclosed by U.S. Pat. No. 5,983,442, the disclosure of which is hereby incorporated by reference.

Figure 6:
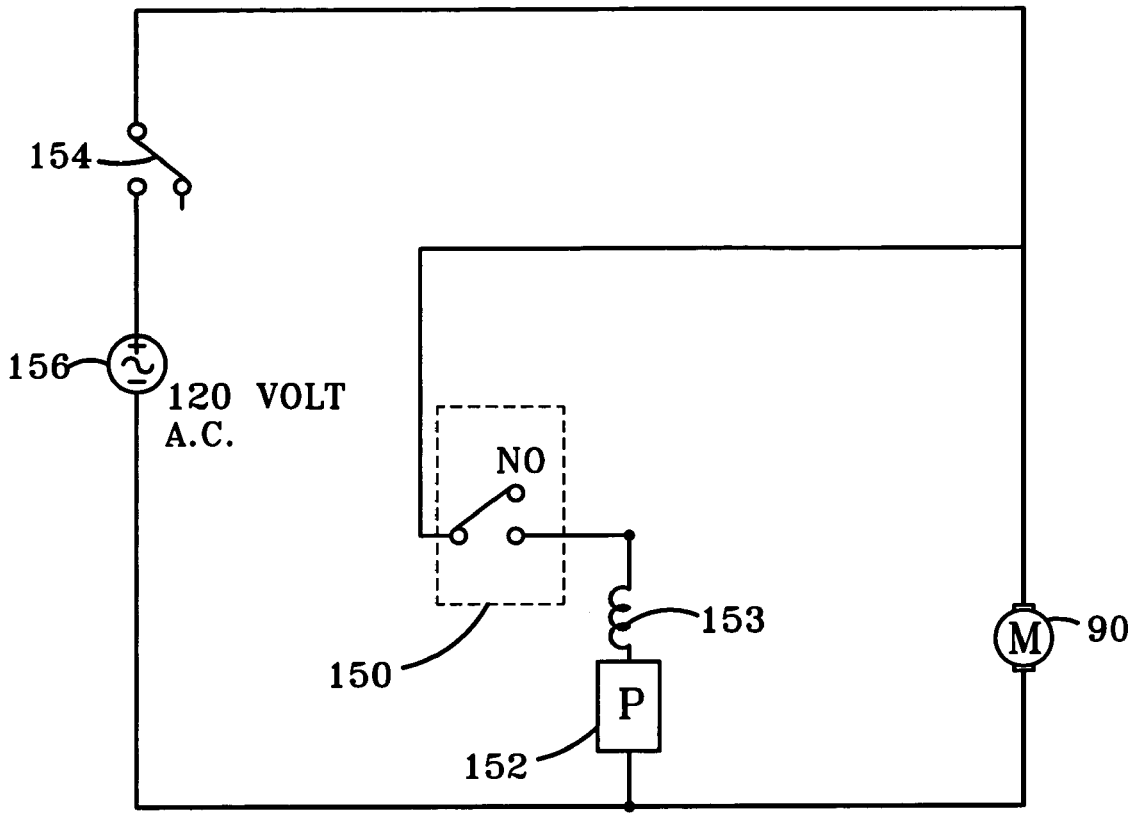
FIG. 6 is a schematic diagram showing the electrical circuit for the suction motor and pump used in the embodiment shown in FIG. 1.
Figure 7:
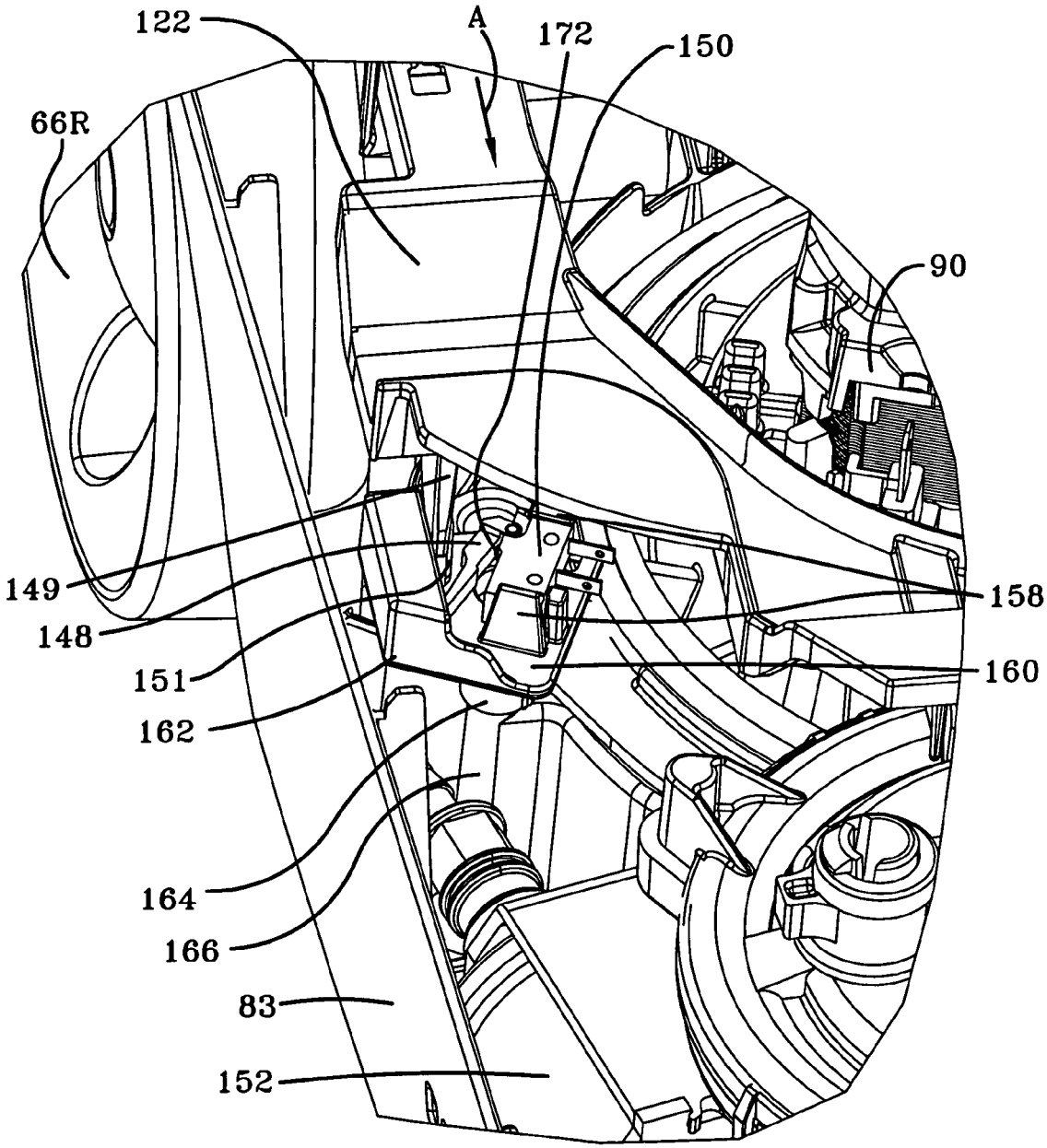
FIG. 7 is a front, side, and top partial perspective view of the lower portion of the base assembly shown in FIG. 5 with the motor cover removed for illustrative purposes.

Turning to FIG. 7, the actuating rod 122 further has a downwardly depending cam projection 149 that cams against a lever 148 of a microswitch 150 to turn on a solenoid pump 152 when the handle assembly 62 is in the upright position and main power switch 154 (FIG. 6) is on for upholstery or above the floor cleaning using the accessory hose. In particular, as seen in FIG. 6, the microswitch 150 is electrically coupled between solenoid 153 of the pump 152 and a power source 156 such as household current. Referring to FIG. 7, the microswitch 150 is captured by clips 158, which are integrally molded to a table 160 of a holder 162, which is mounted to the right side of the frame 83 adjacent the suction motor assembly 90. The holder 162 includes a tubular support boss 164 depending downwardly from the table 160 that telescopingly receives an upwardly extending post 166 integrally molded to the frame 83. As seen in FIGS. 2 and 5, the pump 152 is mounted in a compartment 168 of the frame 83 forwardly adjacent the microswitch 150. The holder 162, microswitch 150, and pump 152 are covered by the motor cover 230. The cam projection 149 of the actuating rod 122 extends into a slot 170 formed in the motor cover 230 for guiding the projection 149 to the lever 148 of the microswitch 150.

As best seen in FIG. 7, the microswitch 150 includes a spring-loaded pushbutton 172 aligned underneath the lever 148. The microswitch 150 is normally open as seen in FIG. 6. When the handle assembly 62 is moved to the upright position, the cam projection 149 moves forward as indicated by the arrow A, guided by guide projection 151, and cams against the lever 148, which pushes the pushbutton 172 to close or complete the circuit between the power source 156 and pump 152, thereby energizing the solenoid 153 (FIG. 6) to turn on the pump 152. When the handle assembly 62 is in the inclined or working position, the cam projection 149 is disengaged from the lever 148, thereby allowing the pushbutton 172 to extend, which opens the circuit between the power source 156 and pump 152 thereby turning off the pump 152. The pump 152 is designed and constructed to provide enough pressure to draw the cleaning solution to spray mechanism of accessory hose. Alternatively, other types of pumps can be used such as, for example, a centrifugal pump, gear pump, or air driven turbine pump.

Turning to FIGS. 1, 3, 4 and 8, a floor suction nozzle assembly 174 is mounted to a depressed zone 176 (FIG. 3) on the hood portion 82 of the base assembly 64. In particular, as seen in FIG. 8, the floor suction nozzle assembly 174 includes a translucent front plate 178 removably mounted to a translucent rear plate 180 to form a flowpath going from its inlet 187 to outlet 189. The rear plate 180 is fixedly mounted to the depressed zone 176 by any suitable mounting means such as, for example, screws. As seen in FIG. 4, integrally molded on the underside of the rear plate are stiffening ribs 196R, 196L oriented longitudinally with respect to the base assembly 64, and a stiffening rib 198 oriented transverse to base assembly 64. The rear plate 180 includes integrally molded translucent opposite side portions 182R, 182L, which extend rearwardly from the front of the rear nozzle plate 180. The side portions 182 are located outwardly adjacent the brush assembly 70 and extend over or cover the side ends of the brush assembly 70 such that the brush assembly 70 can be viewed through them as seen in FIG. 1. Each side portion 182 includes a recessed portion 184 (FIG. 3) that receives complimentary side portions 186R, 186L of the front plate 178 to aid in retaining the front plate 178 to the rear plate 180, while also providing a relatively smooth appearance due to the front plate 178 being flushed with the rear plate 180. As best seen in FIG. 4, a groove 188 is formed in the bottom edge 192 (FIG. 3) of the recessed portion 184 for receiving a lateral inwardly extending projection 190 integrally molded on the corresponding side portion 186 of the front plate 178. Each side portion 186 of the front plate 178 also has an inwardly extending rib 194 spaced forwardly of the projection 190 that abuts the bottom edge 192 (FIG. 3) of the side portion of the rear plate 180, which prevents the front plate 178 from pivoting down to the surface 74.

As depicted in FIG. 8, the upper or rear end of the front nozzle plate 178 defines a tab or hand grip 200 that has a downward depending rib or stop member 210, which catches behind a raised portion 212 on the rear or upper portion 214 of the rear nozzle plate 180 to secure the front nozzle plate 178 to the rear nozzle plate 180. To remove the front nozzle plate 178, a user grasps the hand grip 200 and pulls upward to disengage the stop member 210 from the raised portion 212 and then slides the front nozzle plate 178 down to unseat the projection 190 (FIG. 4) from the groove 188 (FIG. 4). The front nozzle plate 178 then can be slid forward and removed. A rubber rope seal 216 is sandwiched between the front and rear nozzle plates 178, 180 to prevent fluid leakage.

The outlet 189 of suction nozzle assembly 174 is fluidly connected to an inlet 218 (FIG. 3) of a working air conduit, which is formed by the upper portion 214 of the rear nozzle plate 180 and the upper portion 220 of the depressed zone 176. The upper portion 220 is raised so as to be flushed with the rear nozzle plate 180 and includes a seal 226 (FIG. 3) secured therearound. The conduit is fluidly connected to an inlet 232 of a unitary, plastic, floor recovery duct 222. The floor recovery duct 222 is mounted to the motor cover 230. A seal 224 is secured around the connecting area of the conduit and floor recovery duct 222 to prevent fluid leakage. A corrugated flexible floor recovery hose 228 (FIG. 9) is fluidly connected to the outlet 234 of the floor recovery duct 222 via a sleeve connector 236 (FIG. 9).

As best seen in FIGS. 2 and 12, the base assembly 64 further comprises a pedal 238 that operates the on/off power switch 154. The switch 154 is a push-push type power switch, which is mounted in a pocket 242 of the frame 83 by an elongated holder 240 extending laterally from trunnion bracket or retainer 262L. The pedal 238 is generally triangular shaped sloping and converging rearwardly and downwardly as best seen in FIG. 1. An integrally molded lateral leg 246 extends forwardly from the pedal 238 and terminates into an s-shaped spring arm 248. As seen in FIG. 12, the spring arm 248 bears against the upper wall of the holder 240 to bias the leg 246 down so that cam projection 247 of the leg 246 does not press against the push button 250 of the power switch 154. Pushing downwardly on the pedal 238 with sufficient force to overcome the elastic force of the spring arm 248 causes the cam projection 247 to push the push button 250 which causes the power switch 154 to close the circuit (FIG. 6) between the power source 156 and suction motor 90 and also between the power source 156 and pump 152 (if the handle assembly 64 is in the upright position), thereby turning on the suction motor 90 and pump 152. When the pedal 238 is released, the spring arm 248 urges the leg 246 down to allow the push button 250 to extend. The push button 250 is now in a position to open the circuit between the power source 156 and suction motor 90 upon being depressed. Thus, pushing the pedal 238 again causes the cam projection 247 to push the push button 250 and turn off the suction motor 90 and also power to the pump 152 (if the handle is in the upright position).

Figure 9:
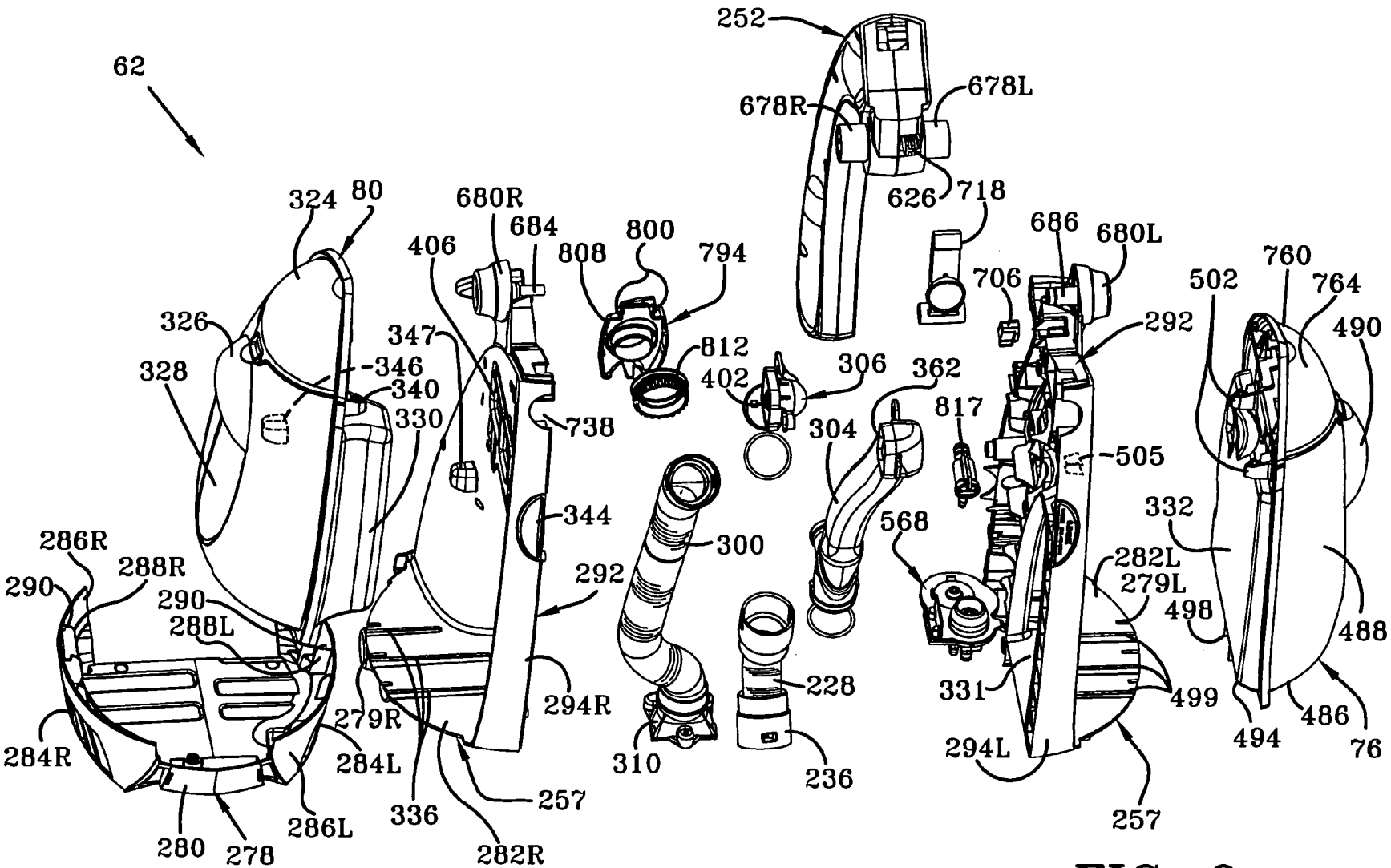
FIG. 9 is an exploded view of the handle assembly of the carpet extractor of FIG. 1.

Referring to FIG. 2, the lower handle body 254 of the handle assembly 62 includes a pair of opposite side extensions 256L, 256R depending downwardly from a shelf or platform 257, which supports the solution and recovery tanks 76, 80 (FIG. 9). The side extensions 256 have integral trunnions 258L, 258R. The right trunnion 258R is pivotally received in an aperture 260 through right trunnion bracket or retainer 262R, which is mounted to the rear of the frame 83. The left trunnion 258L is pivotally mounted on the rear of the frame 83 by a left trunnion bracket or retainer 262L, which has an arcuate portion 257 (FIG. 12) covering the left trunnion 258L. In essence, the trunnion brackets 262L, 262R are mounted over the trunnions to cover them, thereby pivotally securing the handle assembly 62 to the base 64. As seen in FIG. 12, the left trunnion 258L has a notch 259 that receives a stop projection 261 on the frame. If the handle assembly 62 is pivoted down too far, the rear end 263 of the notch strikes the stop, thereby preventing further pivoting of the handle assembly 62.

Figure 10:
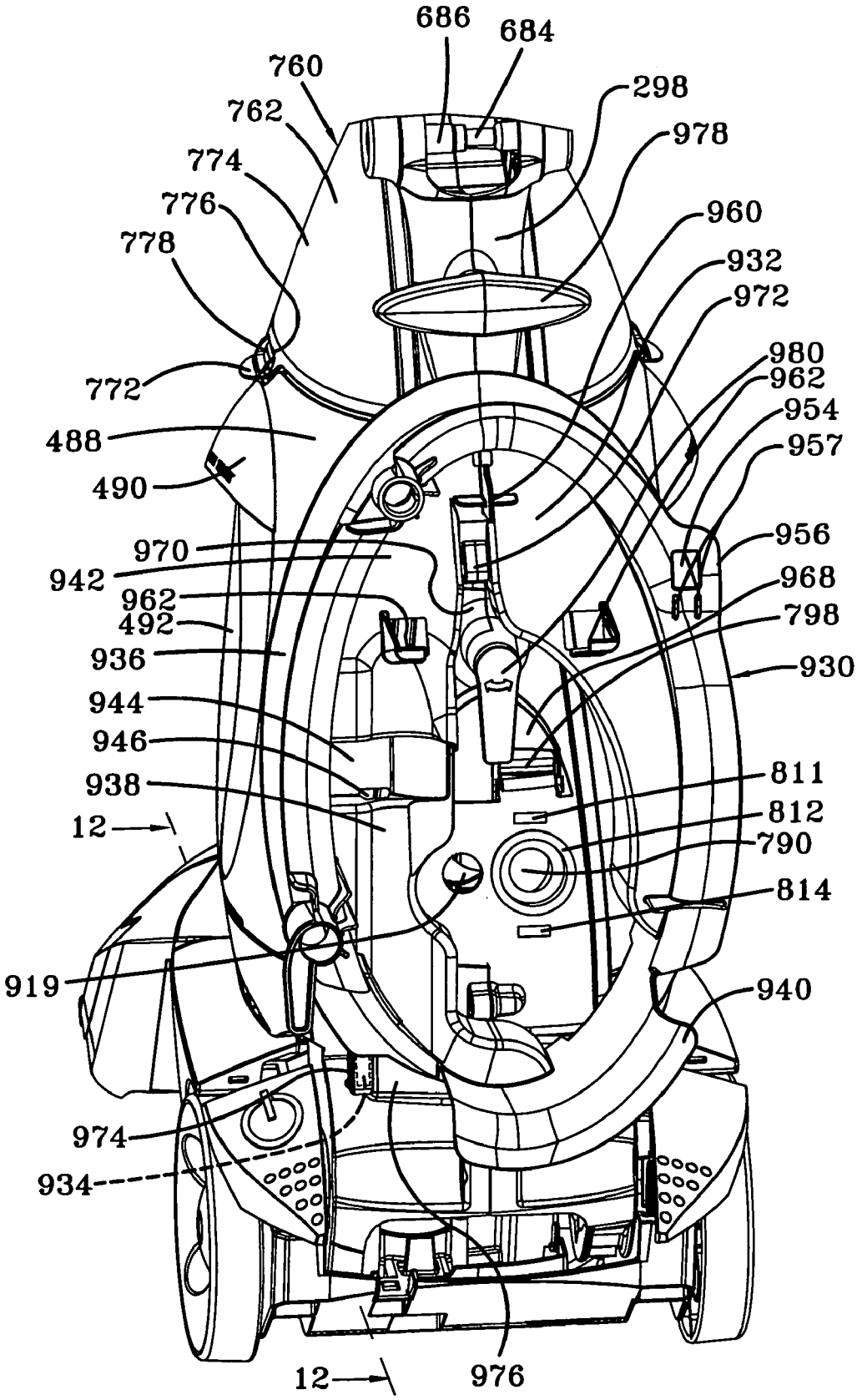
FIG. 10 is a rear perspective view of the carpet extractor of FIG. 1 with portions broken away for illustrative purposes.
Figure 11:
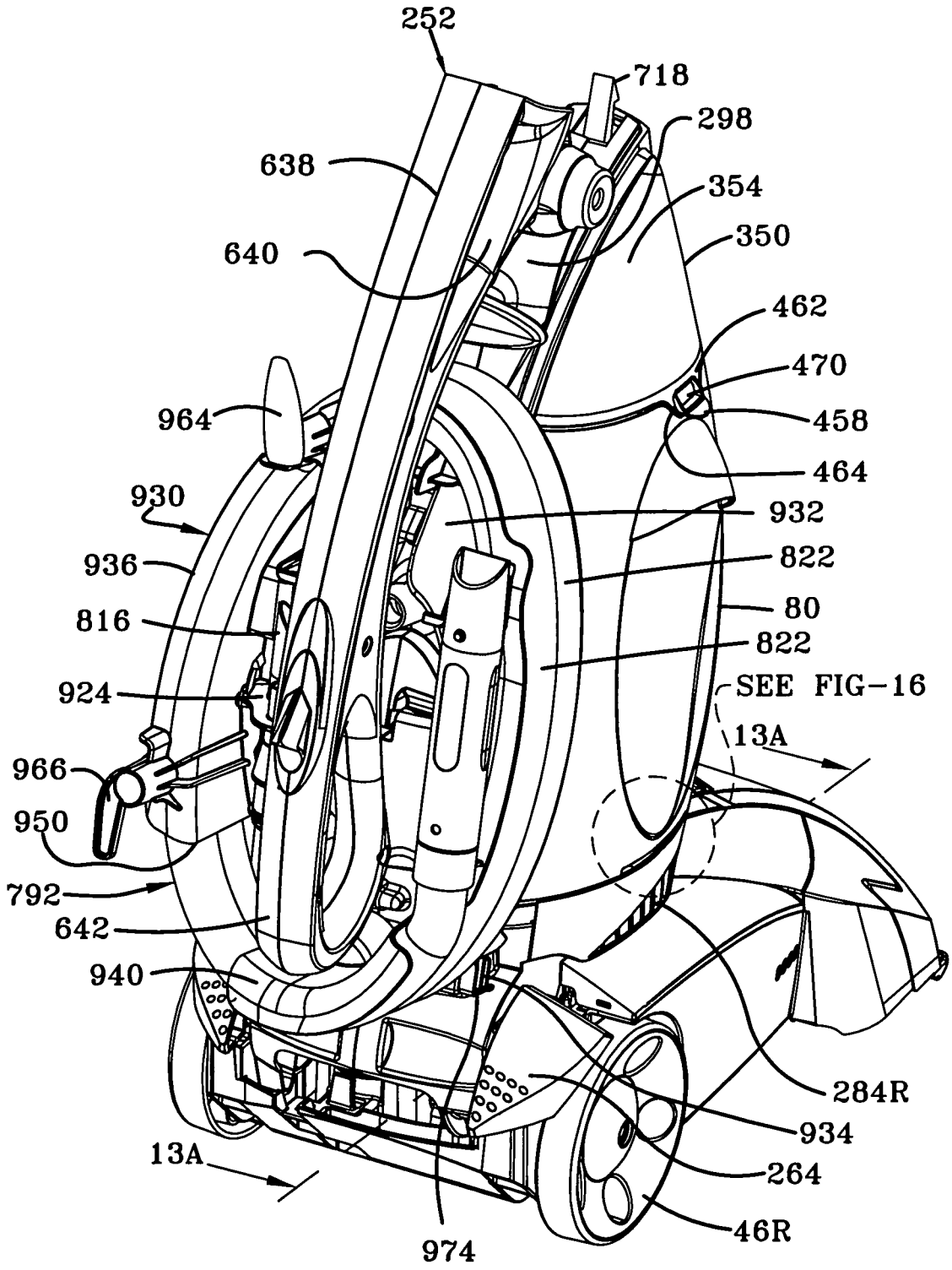
FIG. 11 is rear and right side perspective view of the carpet extractor of FIG. 1 but with the accessory hose assembly on the caddy and the upper handle portion folded down.
Figure 13B:
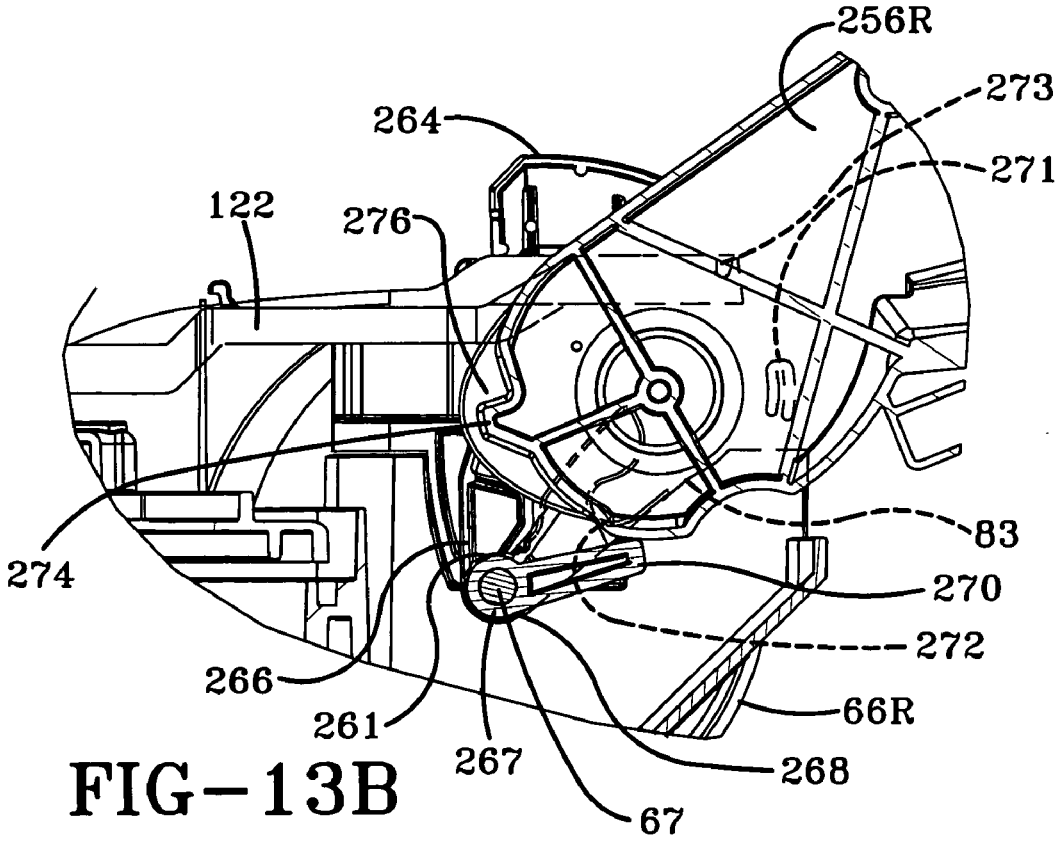
FIG. 13B is a view similar to FIG. 13A except that the handle assembly is in the inclined use position.

A handle release pedal 264 is pivotally connected to the axle 67 of the right wheel 66R as seen in FIGS. 2, 11, 13A and 13B. The pedal 264 is generally triangular shaped sloping and converging rearwardly and downwardly as seen in FIGS. 10 and 11. As depicted in FIGS. 13A and 13B, a leg 266, integrally molded to the pedal 264, extends forwardly therefrom. An elongated hollow pivot rod 267 is attached at its outer end to the leg 266 and extends inwardly, telescopingly receiving the axle of the right wheel 66R. The rod 267 is seated in an arcuate surface 268 of the frame 83 and is covered by an arcuate surface 261 of the trunnion bracket 262R. A finger 270 is integrally formed with the rod 267 and extends rearwardly. An s-shaped spring arm 272, integrally formed with the leg 266 and spaced rearwardly from the leg 266, extends downwardly and bears against the frame 83.

As depicted in FIG. 13A, the spring arm 272 urges the finger 270 upwardly such that it is positioned forwardly adjacent a stop 274, integrally formed on the outer surface of the right extension 256R of the lower handle body 254. The finger 270 is also positioned in between integral guide walls 276 extending forwardly from the stop 274 to align the finger 270 with the stop 274.

In this position, the finger 270 engages the stop 274 thereby preventing the handle assembly 62 from pivoting down. However, when the pedal 264 is depressed, the elastic spring arm 272 bends to allow the finger 270 to pivot down and away from the stop 274 and thus, the handle assembly 62 is permitted to pivot down as seen in FIG. 13B.

Referring to FIG. 9, a lower handle cover 278 is mounted to the underside of the platform 257 and includes a skirt 280 that covers the exposed top portion of the motor/fan assembly 90 with cover 230 and floor recovery duct 222, when the handle assembly 62 is in the upright position as seen in FIG. 1. The skirt 280 includes left and right symmetrical vent portions 284L, 284R formed on its opposite sides for venting the motor cooling air entering and exiting the suction motor 80, when the handle assembly 62 is in the upright position. The lower handle cover 278 also includes upwardly extending left and right symmetrical lip portions 286L, 286R integrally molded with the skirt 280 and positioned on opposite side ends of the platform 257 that retain the lower portions of the solution and recovery tanks 76, 80 to the handle assembly 62, when the tanks are mounted on the platform 257. In particular, the platform 257 is formed by left and right symmetrical halves 282L, 282R secured to each other. The right lip portion 286R is positioned on the outer end of the right half 282R of the platform 257 for supporting the recovery tank 80. The left lip portion 286L is positioned on the outer end of the left half 282L of the platform for supporting the solution tank 76.

Three integral locating ribs 288R extend inwardly from the right lip portion 286R into corresponding slits 279R formed in the right half 282R of the platform 257. Similarly, three symmetrical integral locating ribs 288L extend inwardly from the left lip portion into slits 279L formed in the left half 282L of the platform 257. The ribs 288 include upper rounded ends 290 that extend above the height of the lips 286. The upper ends 290 of the ribs 288 pivotally engage grooves 338, 500 (FIGS. 16 and 22) formed on the underside of the bottom walls 318, 486 of their respective recovery tank 80 or solution tank 76 to guide the tank into the proper mounting position. The lower handle body 254 includes a spine 292 integrally molded to the platform 257 and positioned generally between the solution and recovery tanks 76, 80. The spine 292 comprises right and left half shells 294R, 294L mounted to each other forming a clamshell type arrangement for ease of assembly of the components therein. The right half shell 294 is integrally molded to the right half 282R of the platform 257 and the left half shell 294L is integrally molded to the left half 282L of the platform 257. An inverted u-shaped opening 331 is formed near the middle of the spine 292 splitting the spine 292 into front leg 296 (FIG. 1) and rear leg 298 (FIG. 11) that define a wishbone type arrangement. The rear leg 298 curves rearwardly and down to the rear end of the platform 257 and the front leg 296 curves forwardly and down to the front end of the platform 257.

Figure 14A:
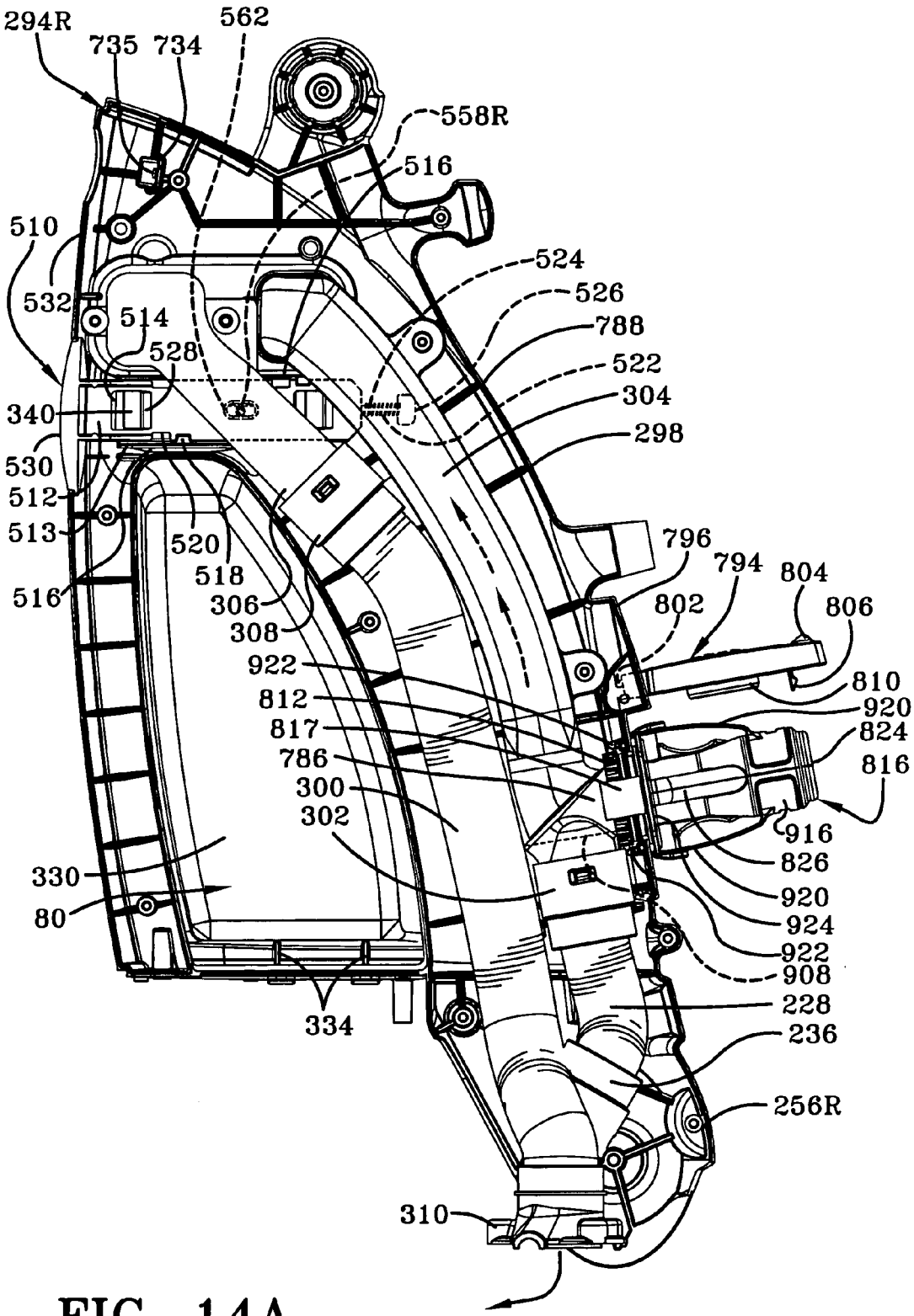
FIG. 14A is a left side view of the right portion of the lower handle body of the handle assembly with the hose connector assembly fluidly connected to the lower handle body for the carpet extractor of FIG. 1.
Figure 14B:
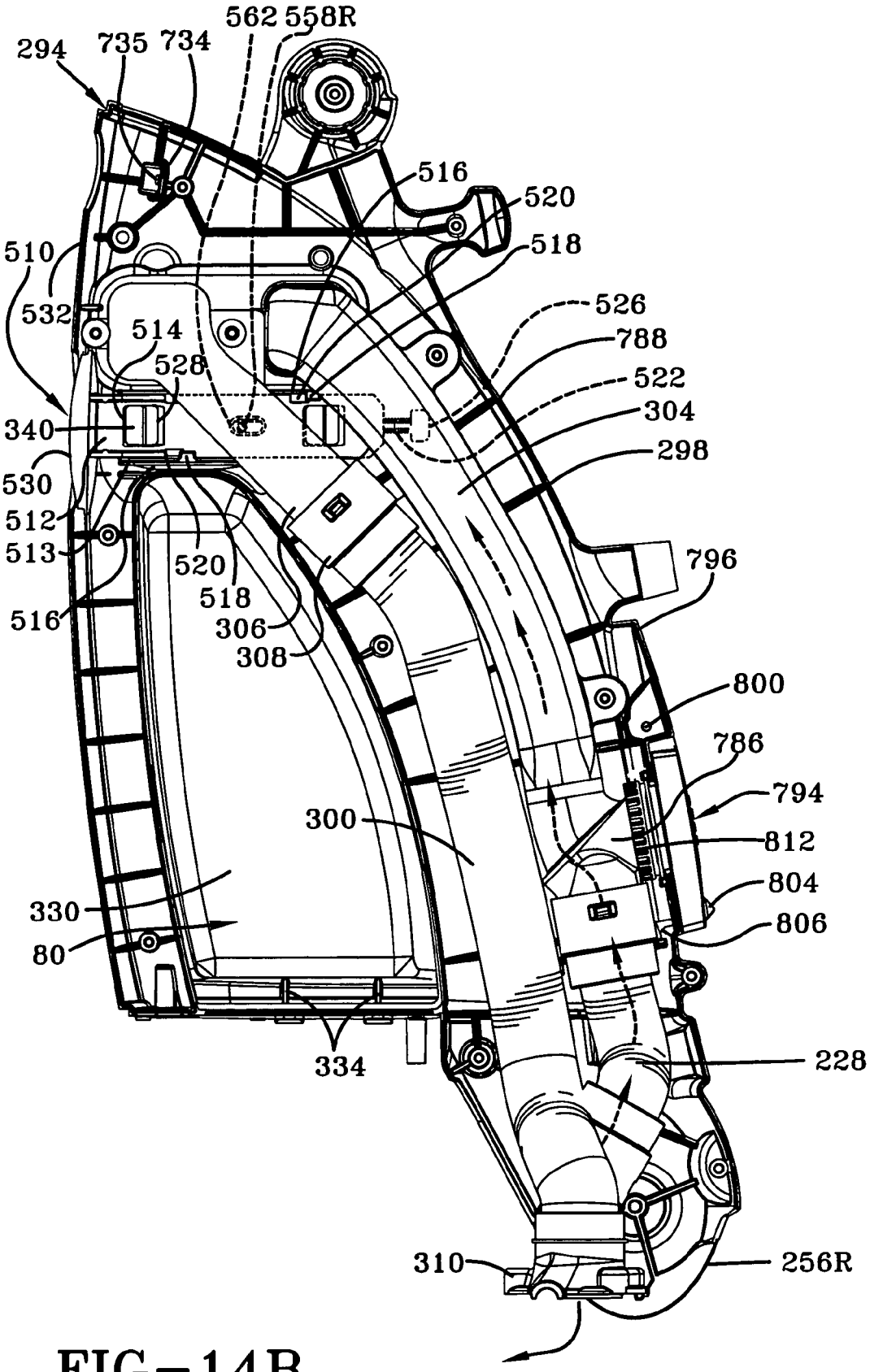
FIG. 14B is view similar to FIG. 14A except that the hose connector assembly and solution discharge valve are removed, the accessory door is closed, and the recovery tank latch is moved rearwardly unlatching the recovery tank from the handle assembly.

As seen in FIGS. 14A and 14B, mounted within the right half shell 294R at the rear leg 298 is the floor recovery hose 228. Connected to the upper end of the floor recovery hose 228 by a sleeve connector 302 is a rigid, unitary, blow molded, main recovery duct 304, which is also mounted within the right half shell 294R. The main recovery duct 304 is in fluid communication upstream with the recovery tank 80. The recovery tank 80 is in fluid communication downstream with a rigid, plastic, injection molded elbow duct 306, when the recovery tank 80 is mounted to the handle assembly 62. The elbow duct 306 is fluidly connected at its downstream end via a sleeve connector 308 to the corrugated air exhaust hose 300. Each of the sleeve connectors 236, 302, 308 use a male and female snap type connection to their respective ducts 222, 304, 306. Also, the sleeve connectors 236,302, 308 are encapsulated to the ends of the hoses 228, 300 as the connectors 302, 308 are being molded. Both the elbow duct 306 and air exhaust hose 300 are located forwardly adjacent the floor recovery hose 228 and main recovery duct 304 and also mounted within the right half shell 294R.

Figure 19B:
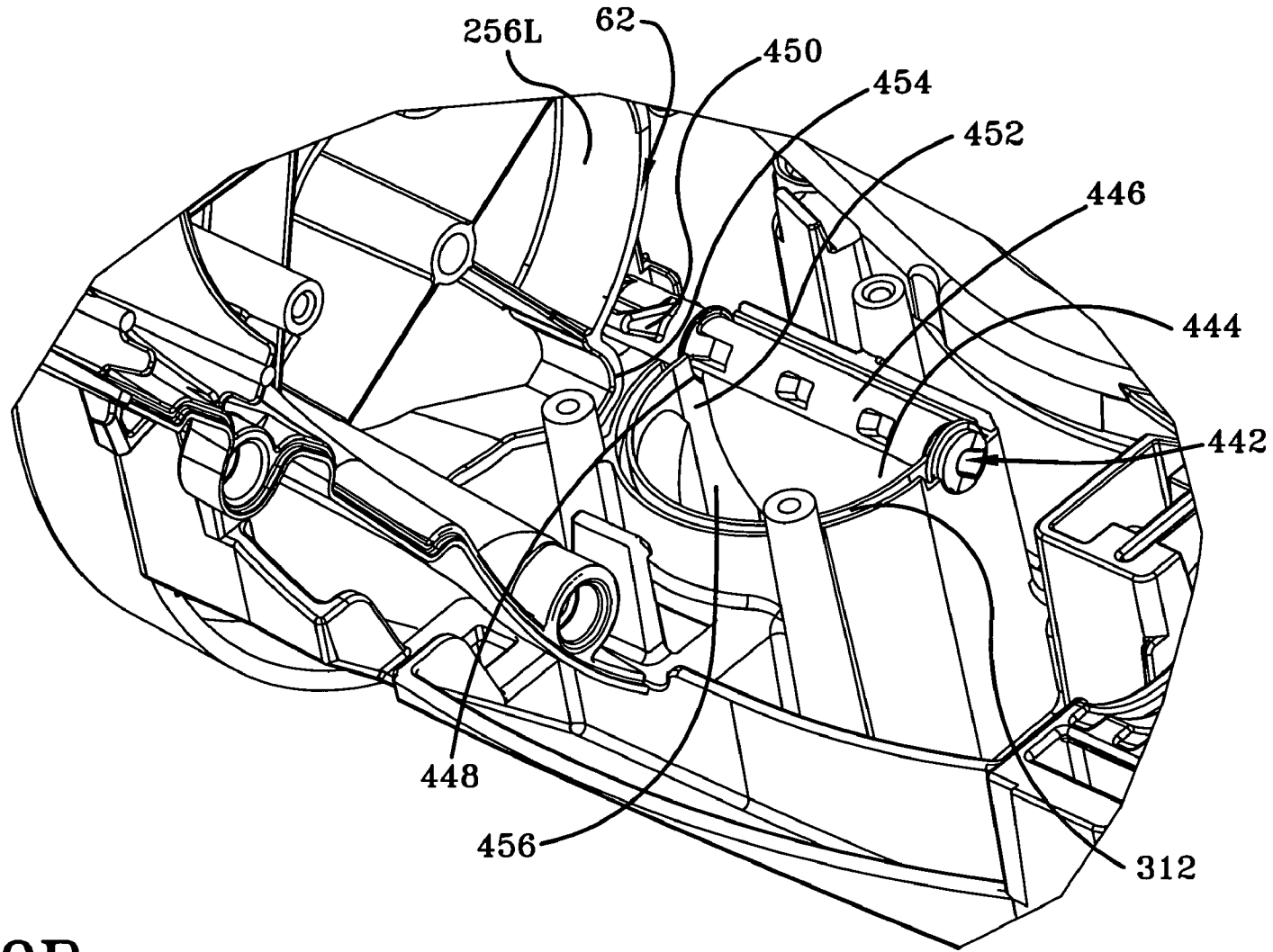
FIG. 19B is a view similar to FIG. 19A but showing the stop valve in the open position.
Figure 20:
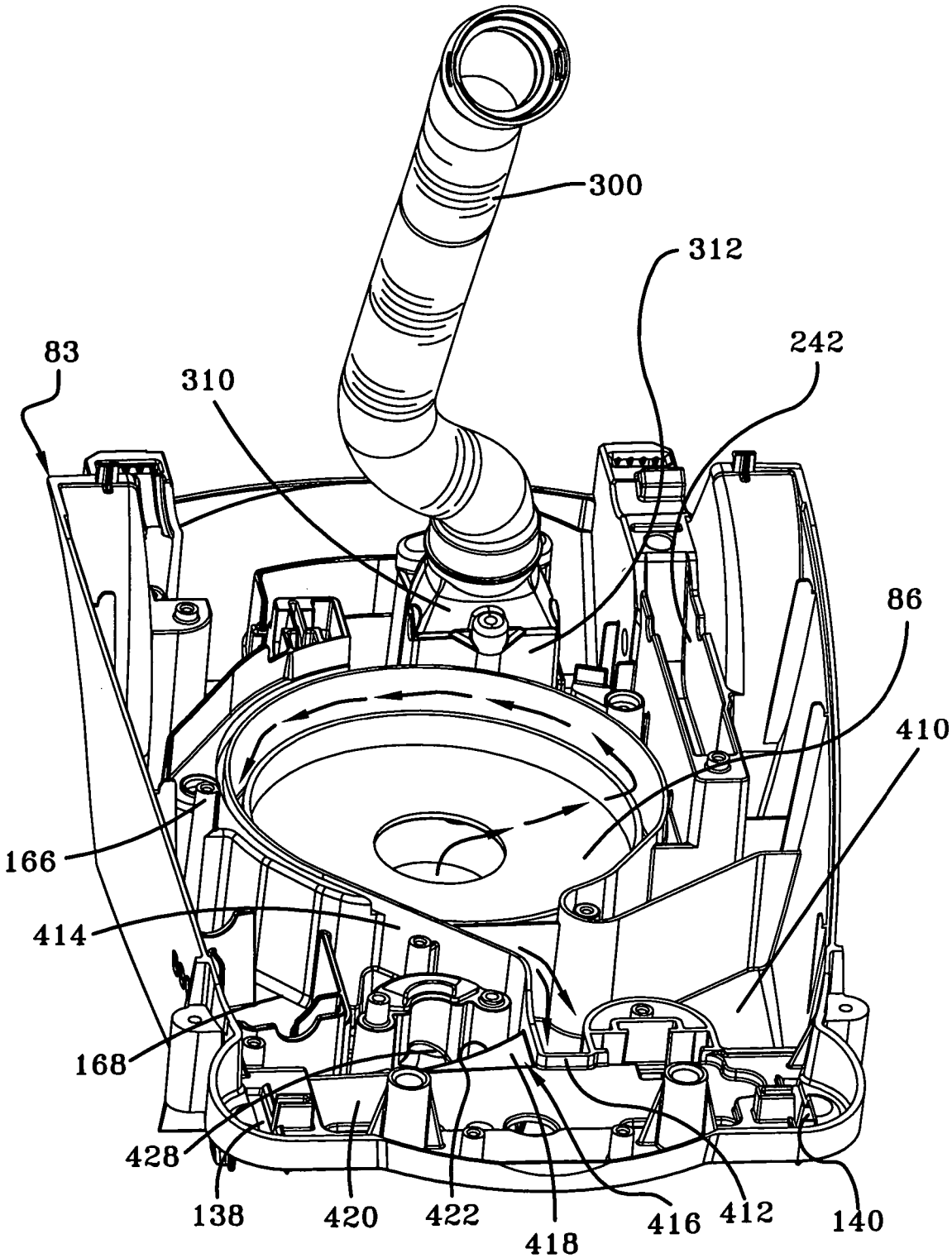
FIG. 20 is a perspective view of the frame of the base assembly with the air exhaust hose mounted to the standpipe for the carpet extractor of FIG. 1.

A hose mounting member 310 is attached to the downstream end of the air exhaust hose 300 and mounts the hose 300 to the frame 83 in fluid communication with a standpipe 312, which is integrally molded to the frame 83 as seen in FIG. 20. The standpipe 312 has a semi-circular cross section, as depicted in FIG. 19B, and is in fluid communication with the vacuum manifold 102 via conduit 303 (FIG. 4). The main recovery duct 304, elbow duct 306, and the upper portions of the floor recovery hose 228 and air exhaust hose 300 are enclosed and captured by the left half shell 294L at the rear leg 298. The flexibility of the floor recovery hose 228 and air exhaust hose 300 allows the handle assembly 62 to pivot and also permits the hoses 228, 300 to bend and conform to the curved contour of the rear leg 298 of the spine 292.

Figure 15:
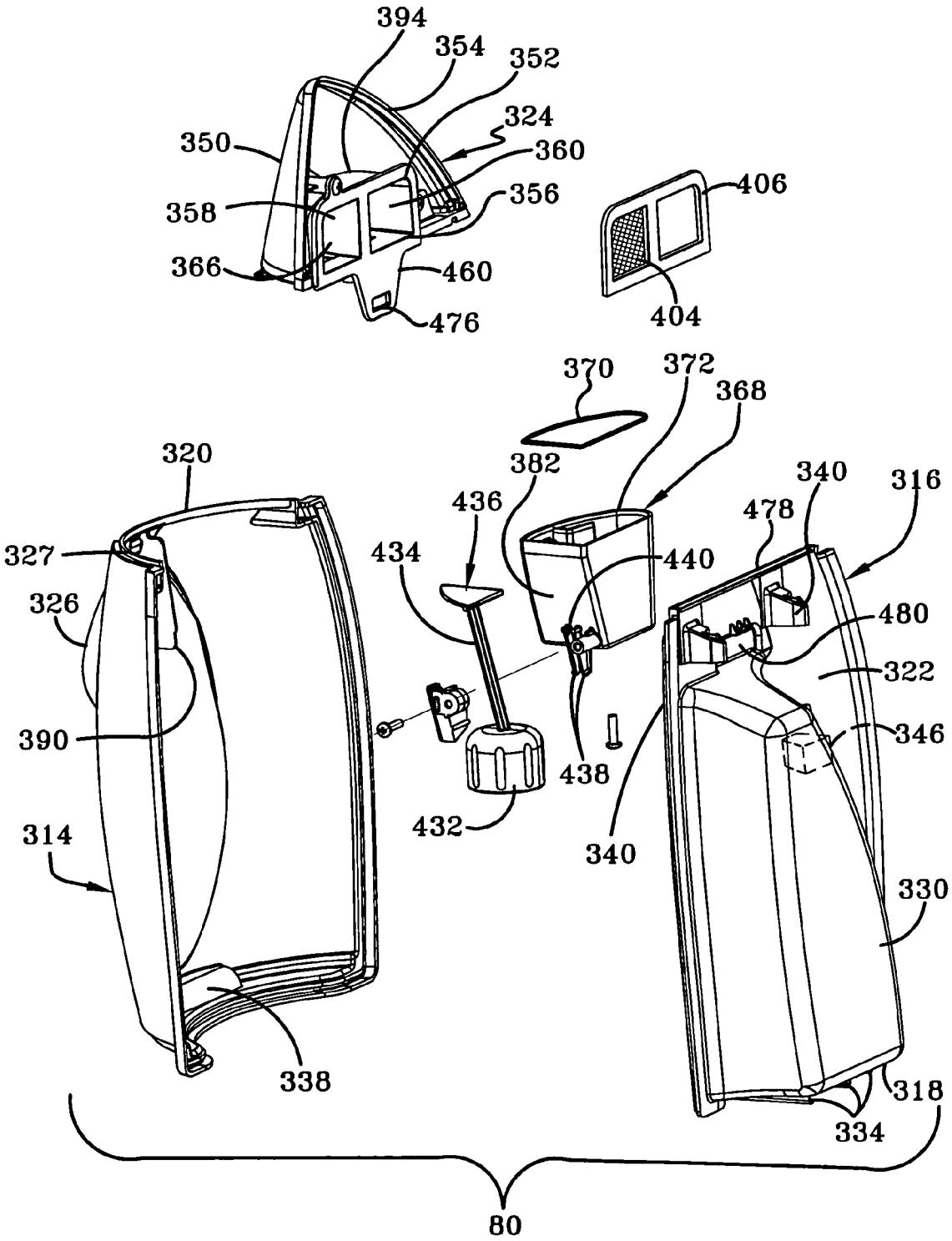
FIG. 15 is an exploded view of the recovery tank assembly and related elements for the carpet extractor of FIG. 1.

Referring to FIG. 15, the recovery tank 80 comprises right and left side halves 314, 316 welded together to define a bottom wall 318, an upstanding convexly curved right sidewall 320, and a left sidewall 322 opposite the right sidewall 320. The recovery tank 80 includes lid assembly 324 covering its open top. An inverted cup shaped handle 326 is attached to the upper end of a recessed area 328 (FIG. 9) formed in the right sidewall 320 for grasping the recovery tank 80. A portion of the left sidewall 322 of the recovery tank juts outwardly to define an additional inverted unshaped compartment 330 that fits into the complimentary opening 331 in the spine 292 and abuts against right sidewall 332 of the solution tank 76, when the recovery tank 80 is mounted to the handle assembly 62. Alternatively, the compartment 330 can be slightly spaced apart from the right sidewall 332 or a wall covering the opening can be positioned between the compartment 330 and right sidewall 332 to define a recess with the spine 292 for receiving the compartment 330. Three vertical flexible support plates defining feet 334 depend downwardly from the bottom wall 318 of the recovery tank 80 and are received in complimentary grooves 336 (FIG. 9) formed on the right half of the platform, when the recovery tank is mounted thereon. The feet 334 flex to absorb much of the impact force from the recovery tank 80 striking the platform 257 or other object, thereby minimizing breakage of the recovery tank 80.

Figure 16:
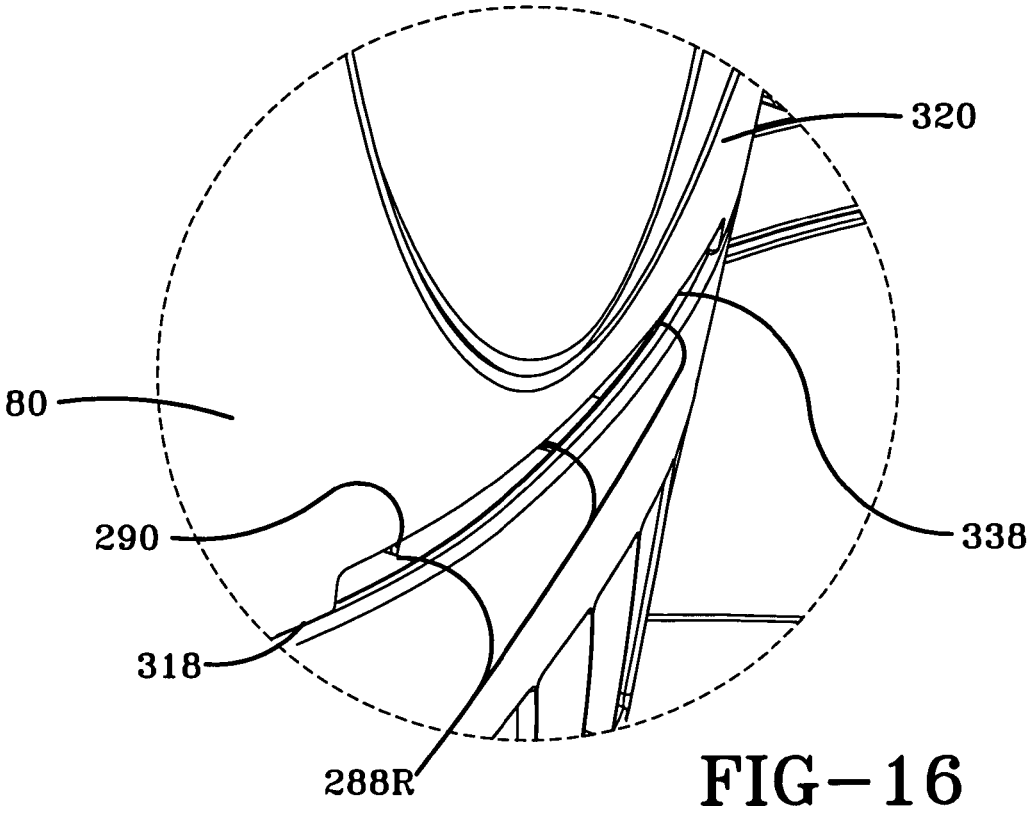
FIG. 16 is an enlarged perspective view of the portion of the carpet extractor as indicated in FIG. 11.

To removably mount the recovery tank 80 to the handle assembly 62, the recovery tank 80 is positioned such that the groove 338 of the bottom wall 318 pivotally engages the upper ends 290 of the ribs 288R as seen in FIG. 16. The recovery tank 80 is then pivoted towards the spine 292 until a pair of lateral hooks 340 (FIG. 15) integrally molded on the left sidewall 322 extend through apertures in the right half shell 294R of the spine and releasably engage a right latch 510 connected to the right half shell 294R as seen in FIG. 14A. Also, with the recovery tank 80 in this position, a recess 346 (FIG. 9) formed in the left sidewall 322 of the recovery tank receives a complementary integrally molded projection 347 (FIG. 9) on the right half shell 294R at the rear leg 298 of the spine 292 for additional support. The recovery tank 80 is generally positioned on the right half 282R of the platform 257 except for part of the compartment 330 that extends over the left half 282L.

Figure 17:
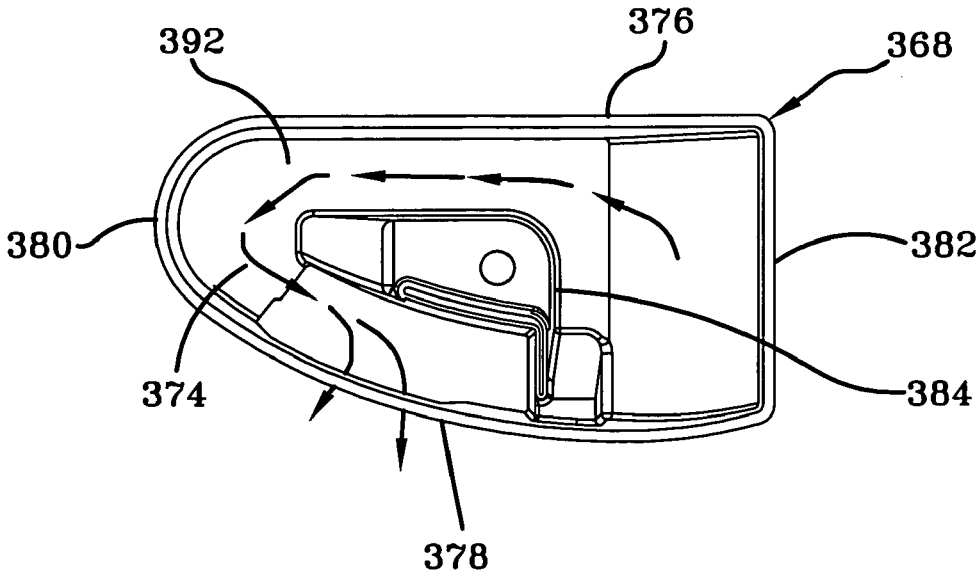
FIG. 17 is a top plan view of the separator of the recovery tank assembly of FIG. 15.
Figure 18:
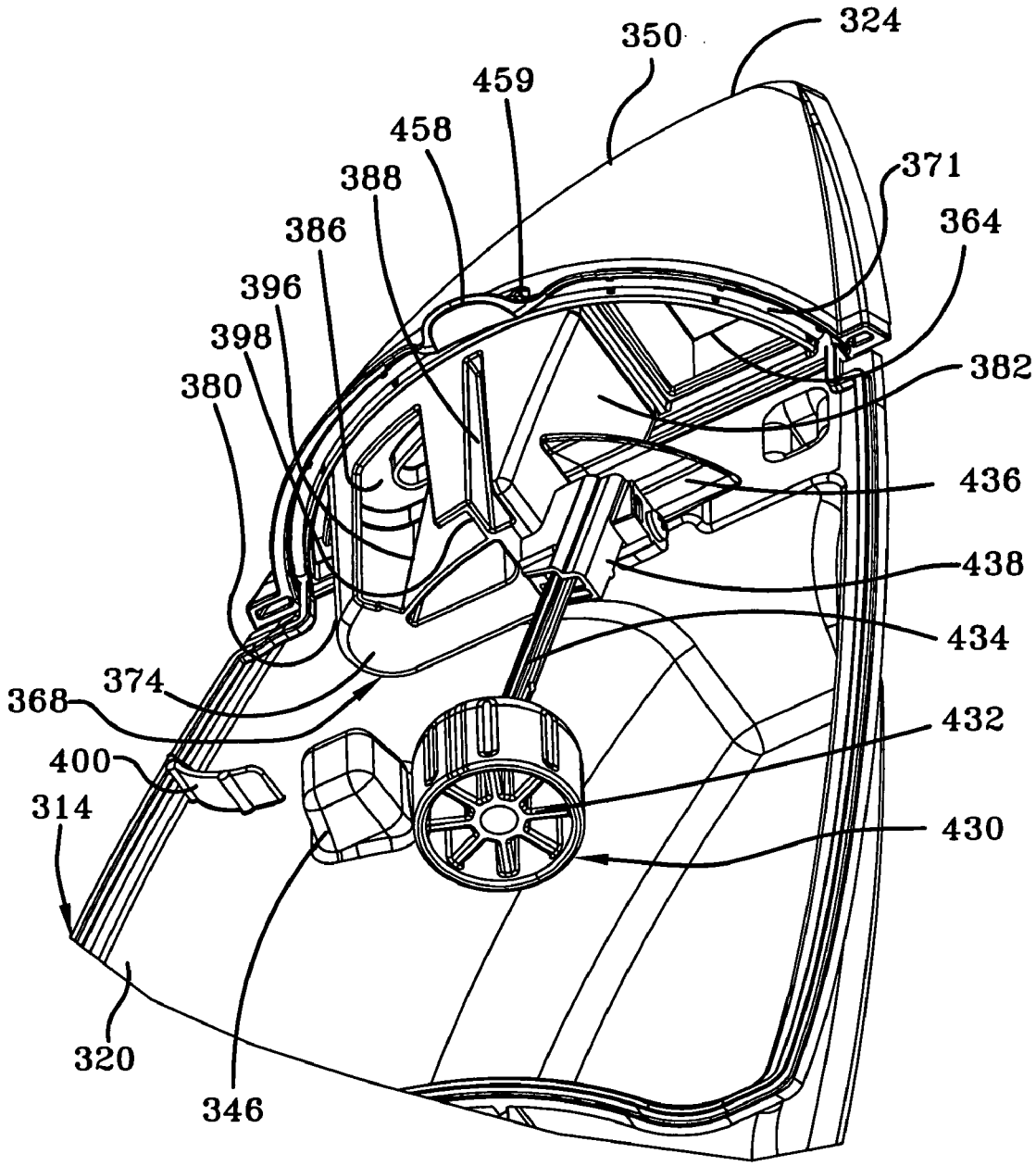
FIG. 18 is a fragmentary right side perspective view of the recovery tank assembly with portions broken away for illustrative purposes.

Referring to FIG. 15, the recovery tank lid assembly 324 has a generally triangular shaped body 354 with its right convexly curved sidewall 350 converging upwardly to an apex. An upper manifold 352 is mounted within the body and comprises an inlet chamber 356 and outlet chamber 358, which is located forwardly adjacent the inlet chamber 356 at the front end 327 of the recovery tank 80. The inlet chamber 356 has an inlet port 360 that is in fluid communication with the outlet 362 (FIG. 9) of the main recovery duct 304, when the recovery tank 80 is mounted to the handle assembly 62. The outlet chamber 358 has an entrance opening 364 (FIG. 18) to the tank 80 and a side exit opening 366 in fluid communication with inlet 402 the elbow duct 306. A separator 368 is mounted to the underside of the manifold 352 and has an open top portion 372 in fluid communication with the inlet chamber 356. A rope seal 370 is sandwiched between the separator 368 and manifold 352. Another rope seal 371 is secured to the lid assembly 324 to seal it with the top of the recovery tank 80, when the lid assembly covers the tank 80. As seen in FIG. 17, the separator 368 includes a bottom wall 374, a left upstanding sidewall 376, a convexly curved right upstanding sidewall 378 located opposite the left sidewall, 376 a curved upstanding rear wall 380, and a front wall 382, which is beveled or inwardly and downwardly sloping with respect to the separator 368 as seen in FIG. 18. An inner raised baffle portion 384 is integrally formed with the bottom wall 374 and right sidewall 378 extends to the center of the separator 368. As seen in FIG. 18, a cut out portion in the right sidewall 378 defines an outlet 386 of the separator 368. A vertical groove 388 is formed on the right sidewall 378 for receiving a vertical baffle plate 390 (FIG. 15) attached to the interior of the right sidewall 320 of the recovery tank 80 to guide the lid 324 to its proper mounting position on the top of the tank 80.

In operation, when the extractor 60 is operated in the floor cleaning mode, working air, including entrained fluid and dirt, is drawn into the floor suction nozzle assembly 174, through the floor recovery duct 222, floor recovery hose 228, main recovery duct 304 and to the lid assembly 324 of the recovery tank 80 as seen by the arrows of FIG. 14B. The recovered soiled liquid laden air enters the inlet port 360 of the inlet chamber 356 and is directed down to a channel 392 of the separator 368 by the downwardly curved top wall 394 of the inlet chamber 356 and curved rear wall of the separator 368. As seen in FIG. 17, the channel 392 is formed by the baffle portion 384 and the front, rear, bottom, and sidewalls of the separator 368. As the soiled liquid laden air flows down to the channel 392, the liquid laden air impinges upon the beveled front wall 382 of the separator 368 as seen by the arrows, which further slows it down to aid in air/water separation. Side 396 (FIG. 18) of the baffle portion 384 opposite the rear wall 380 slopes upwardly and away from the rear wall 380 to provide more area for the liquid to flow down to the channel 392 thereby slowing it down and aiding air/water separation. The liquid collects and flows through the channel 392 around the baffle portion 384 until it exits out the outlet 386 of the separator 368 and down to the bottom of the recovery tank 80.

Near the forward end of the outlet is a barrier wall 398 formed between the baffle portion 384 and right sidewall 378 of the separator 368. The barrier wall 398 and the vertical baffle plate 390 deflect any liquid away from the outlet chamber 358 and prevent the liquid from entering the entrance opening 364 of the outlet chamber 358 and into the motor area. This serves to prevent the establishment of a "short circuited" working airflow from the outlet of the separator directly to entrance opening 364 of outlet chamber. Optionally, an inwardly extending curved baffle 400 (FIG. 18) attached to the inner side of the right sidewall 320 directs flow of liquid forwardly to prevent rapid accumulation of the liquid at the rear portion of the recovery tank 80. The deflection of the air from the baffles and walls and the re-circulation of the stream facilitates separation of the liquid from the air, due to the slowing of the stream, thereby allowing more time for the air to separate from the liquid. Further, when the stream of air is forced to turn, the relatively lighter air is able to negotiate the turn, where as the heavier liquid does not, thereby causing further separation. The working air separated from the liquid flows through the entrance opening 364 in the outlet chamber through the inlet 402 of the elbow duct 306 in fluid communication with the exit opening of the outlet chamber 358. A seal or gasket 406 (FIGS. 15 and 9) is provided between the ducts 304, 306 and manifold 352. A plastic screen 404, attached to the seal 406, covers the inlet 402 of the elbow duct 306 to filter out small particles in the air stream.

After traveling through the elbow duct 306, the working air then travels through the air exhaust hose 300, standpipe 312, and conduit 303 of vacuum manifold 102 (FIG. 4) to the eye of the fan 408 (FIG. 2) of the suction motor 90, which generates the suction to draw the air to the fan 408. As indicated by the arrows depicted in FIG. 20, the working air flows out of the eye of the motor fan 408 into exhaust manifold 410. The exhaust manifold 410 is formed by the lower housing or frame 83 and motor cover 230 (FIG. 5), and a curved partition 414 which extends forwardly to an integrally formed wall 412 adjacent the brush assembly 70. The working airflow is directed by the partition 414 to the front end of the exhaust manifold 410 at the entrance of a channel 416.

The channel 416 is formed by a top wall 418, a front wall 420, and a rear wall 422 of the lower housing 83. A duct cover 424 (FIG. 4), integrally molded with the bottom plate, is mounted over the channel 416. A wall 428, integral with and depending down from the frame 83 to the bottom plate 101, separates or fluidly isolates the channel 416 from the conduit 303. Going from the upstream end to the downstream end of the channel 416, the top wall 418 tapers inwardly or downwardly within the channel 416 and the rear wall 422 tapers inwardly or forwardly within the channel 416 thereby causing the cross sectional area of the channel 416 to gradually decrease going downstream. The air flows at a relatively high velocity to the front end until it hits the wall 412, which directs the air down through the channel 416 and across the length of the duct cover 424, where the air exits out of openings 426 in the duct cover 424. The decreasing cross sectional area of the channel 416 forces the air to flow faster as it travels downstream so as to counteract somewhat the frictional forces and gravity that cause the air to slow down. The channel 416 and openings 426 of the cover 424 also constrict the flow of air thereby increasing its temperature by transforming kinetic energy produced by the working fan into internal energy or heat, which is transferred to the warm, moist, separated exhaust air. Thus, additional heat is provided to the cleaning path.

Referring to FIGS. 15 and 18, a float assembly 430 is slidably mounted to the separator 368 to choke the flow of working air when the recovery tank 80 is full. The float assembly 430 comprises a bottom float portion 432 connected by an elongated arm 434 to an upper portion defining a seal 436. The arm 434 connects the seal 436 and float portion 432 at a rearward and downward slant or slope such that the float portion 432 is positioned slightly rearwardly offset the seal 436. This positions the float assembly 430 closer to the higher portion of the liquid level, when the handle assembly 62 is inclined rearwardly, so as to keep the liquid from rising to a level that is in close proximity to the entrance opening 364 (FIG. 18) of the outlet chamber 358 and possibly entering the motor area. The seal 436 is reawardly offset from the float portion 432 at a predetermined distance that allows the recovery tank 80 to have the same liquid capacity or volume, which causes the seal 436 to close the entrance opening 364, when the handle assembly 62 is in the upright position for above the floor cleaning, or in the inclined position for floor cleaning. The arm 434 has a cross shaped cross section and is slidably received in a complementary slanted channel 440 defined by guide members 438, which are attached to the front and bottom walls 382, 374 of the separator 368. The guide members 438 align the seal 436 with the entrance opening 364 of the outlet chamber 358 as the arm slides through the channel 440.

Figure 18A:
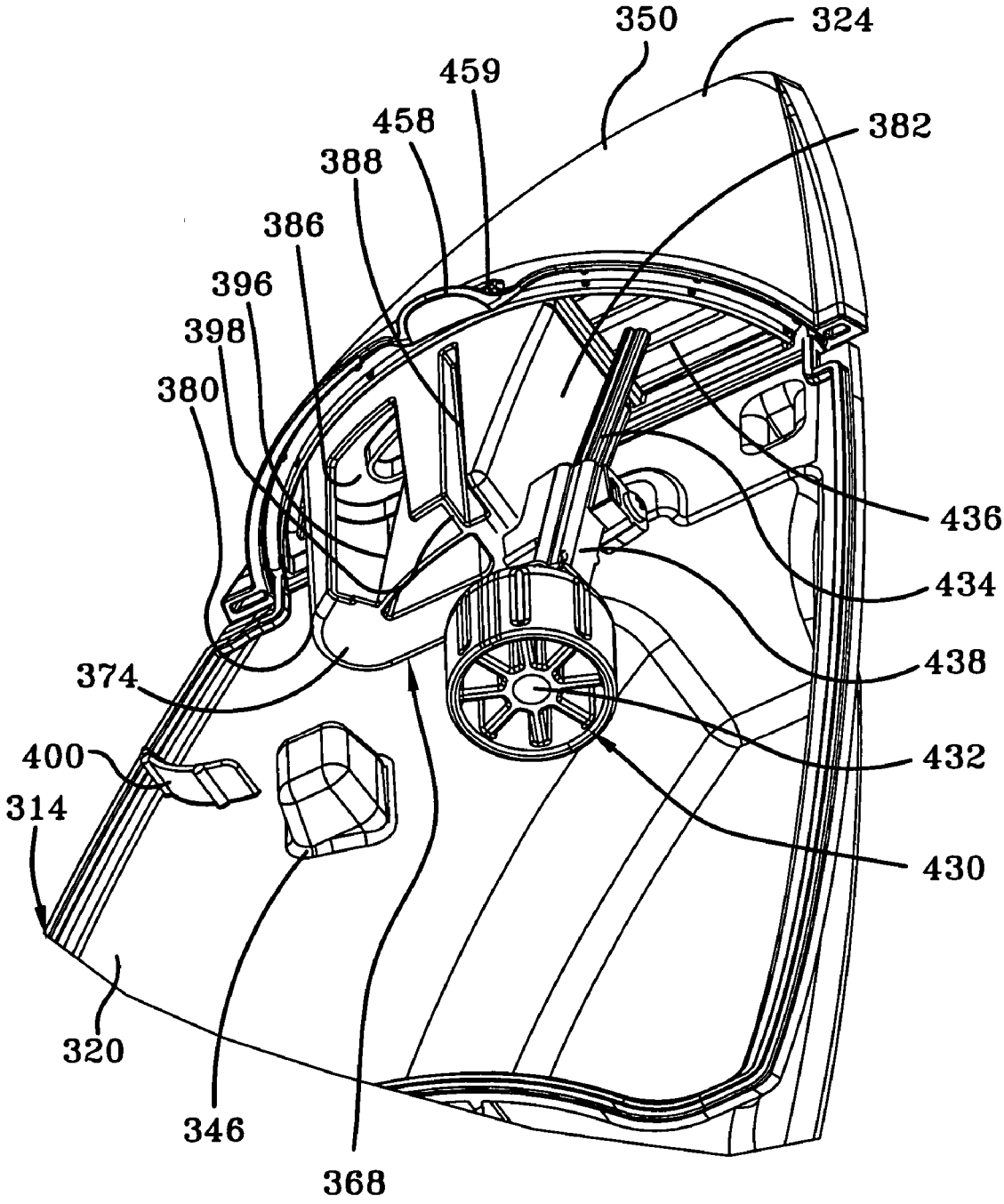
FIG. 18A is a view similar to FIG. 18 but with the float assembly in the closed position.

The slope of the front wall 382 is substantially similar to that of the arm 434 to allow the seal 436 to move along the front wall 382 without interference. When the liquid level in the recovery tank 80 is not contacting the float portion 432, the air flows through the entrance opening 364 and to the motor air as seen in FIG. 18. As the liquid level in the recovery tank 80 rises after contacting the float portion 432, the float portion 432 and seal 436 move upward until the seal 436 closes the entrance opening 364, when the liquid rises to a predetermine level indicative of a full tank as seen in FIG. 18A. In this position, the seal 436 chokes off the flow of working air through the recovery tank 80 and prevents the liquid from entering the motor area. The spaced apart distance between the float portion 432 and seal 436 also prevents liquid from traveling to the seal 436 and entering the motor area due to, for example, sloshing of the liquid in the recovery tank 80 caused by moving the extractor 60 back and forth over the cleaning surface 74.

Figure 19A:
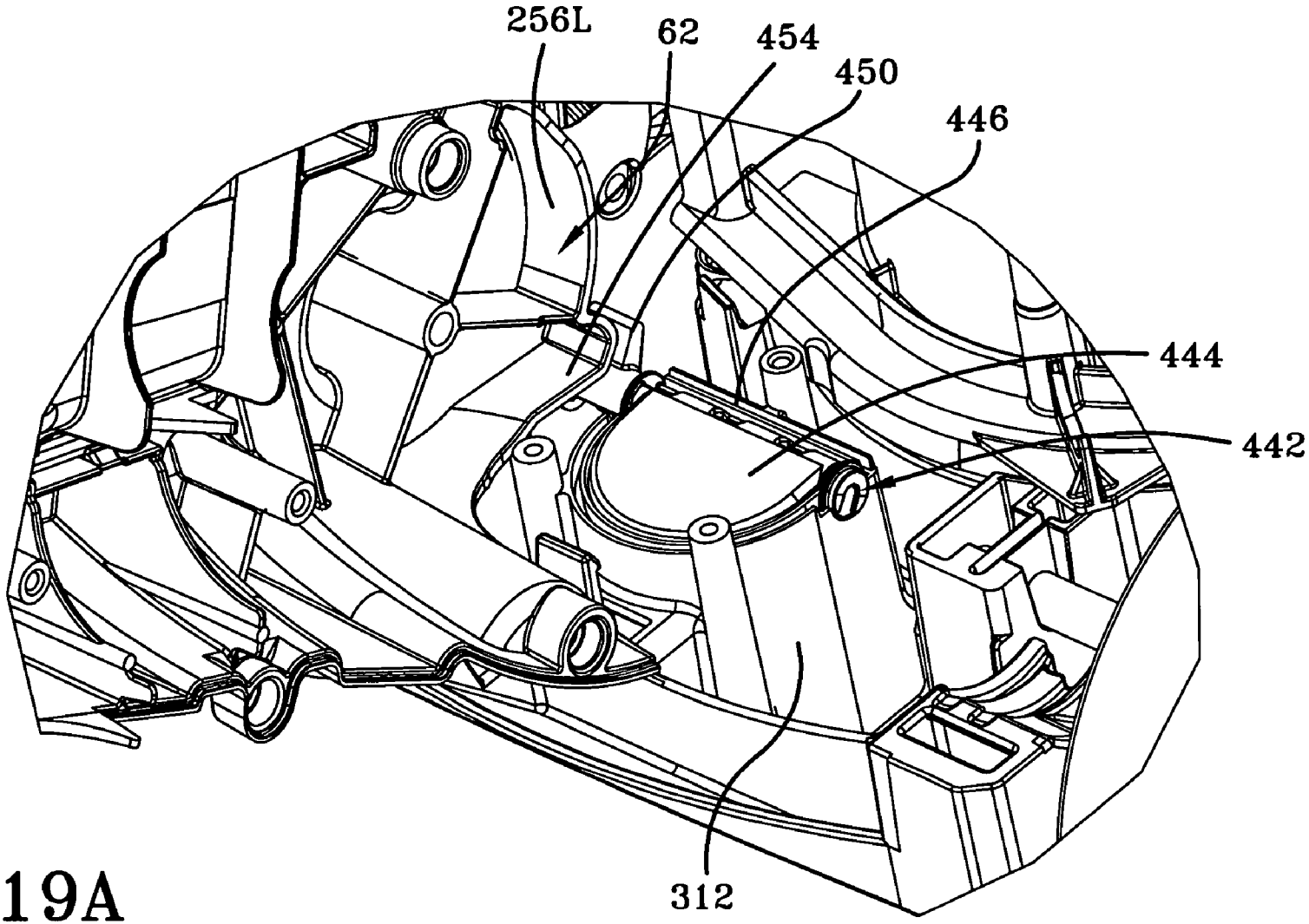
FIG. 19A is a fragmentary perspective view of the base assembly and handle assembly of the carpet extractor of FIG. 1 showing the stop valve arrangement and related elements with the stop valve in the closed position.

Referring to FIGS. 19A and 19B, a stop valve 442 disposed in the standpipe 312 prevents liquid from entering the suction motor if the handle assembly 62 is pivoted down below a predetermined position. Such a near horizontal handle assembly 62 position results in the liquid collecting in the rear of the recovery tank 80 and rising to close proximity to the entrance opening 364. The stop valve 442 includes a door 444 integrally molded with a pivoting shaft 446. The shaft 446 is pivotally received in arcuate surfaces 448 (FIG. 19B) formed on opposite sides of the standpipe 312 near the front portion and captured therein by the hose mount 310 (FIG. 20). A cam follower 450, integrally molded to the shaft 446, projects from the shaft 446. The door 444 is generally semi-circular in shape, conforming to the semi-circular cross section of the standpipe 312, and of a cross sectional area slightly smaller than that of the standpipe 312 so as to allow it to pivot within the standpipe 312. When the handle assembly 62 is in the upright position or pivoted down to the inclined working position, as shown in FIG. 19B, the force of the suction from the suction motor 90 pivots the door 444 down against straight front side 452 of the standpipe 312, thereby opening the stop valve 442 and allowing suction generated by the suction motor to draw air through the standpipe 312.

However, when the handle assembly 62 is pivoted further down to a very low predetermined position, a downwardly extending offset portion 454 on the lower end of the left handle extension 256L cams against the cam follower 450 and pivots the door 444 up to the inlet 456 of the standpipe 312 in a closed position as shown in FIG. 19A. In this position, the door 444 extends across the interior of the standpipe 312 and blocks or substantially blocks the suction from the suction motor, thereby shutting or substantially shutting off suction through the flowpath to the floor suction nozzle assembly 174. Thus, fluid is prevented from being drawn through the flowpath to the suction motor 90. When the handle assembly 62 pivots back to the working position, the offset portion 454 disengages from the cam follower 450 so that the force of the suction from the suction motor 90 pivots the door 444 back down against the front side 452 of the standpipe 312 to the valve open position.

Referring to FIGS. 11 and 15, the lid assembly 324 includes a right tab 458 and a left tab 460 to removably mount the lid assembly 324 and the attached float assembly 430 to the top of the tank. As seen in FIG. 11, the right tab 458 is integrally formed with the convexly curved right side 350 of the lid body 354 and depends downwardly from the lower end 462 of the lid body 354. The right tab 458 fits into a complementary recess 464 of the right wall 320 of the recovery tank 80 and has a slot 459 (FIG. 18) that receives a complementary rib 470 formed on the recess to releasably secure the lid assembly 324 to the recovery tank 80. Grasping and pulling the right tab 458 upwardly and outwardly disengages the slot 459 from the rib 470 thereby allowing the lid assembly 324 to be removed, if the left tab 460 is also disengaged from the recovery tank 80.

As seen in FIG. 15, the left tab 460 is integrally formed with the left bottom end of the lid manifold 352 and depends downwardly from the bottom of the manifold 352. The left tab 460 has a slot 476 that receives a rib 478 formed on the left sidewall 322 of the recovery tank 80. The left tab 460 partially extends over a recess 480 formed in the left sidewall 322. The recess 480 provides access to grasp the left tab 460 by a finger or thumb of a user and also abuts the left sidewall 376 of the separator 368, thereby preventing deformation of the left sidewall 322 of the recovery tank 80. Grasping and pulling the left tab 460 outwardly disengages the slot 476 from the rib 478 thereby allowing the lid assembly 324 to be removed, if the right tab 458 is also disengaged from the recovery tank 80. The right and left tabs 458, 460 function together to properly seal the lid assembly 324 on the recovery tank 80. Alternatively, the lid assembly 324 could include only one of the right and left tabs 458, 460 to removably mount the lid assembly 324 to the recovery tank 80. Further, a reversal of these parts could be designed in that the recovery tank 80 includes the tabs and the lid assembly includes the recesses and ribs.

Referring to FIG. 9, the solution tank 76 is removable mounted to the left platform half 282L and the left half shell 294L of the spine 292. The solution tank 76 comprises two side halves 482, 484 (FIG. 21) welded together to define a bottom wall 486, an upstanding convexly curved left sidewall 488, and a right sidewall 332 opposite the outer sidewall. An inverted cup shaped handle 490 is attached to the upper end of a recessed area 492 (FIG. 1) formed in the left wall for grasping the solution tank 76. The right sidewall 332 juts out in the right direction to define a compartment 494 that is received by a recess 496 (FIG. 23) formed in the left side of the left half shell 294L. Three vertical flexible support plates defining feet 498 (FIG. 21) depend downwardly from the bottom wall 486 of the solution tank 76 and are received in complimentary grooves 499 formed on the left half 282L of the platform, when the solution tank 76 is mounted thereon. The feet 498 flex to absorb much of the impact force from the solution tank striking the platform or other object, thereby minimizing breakage of the solution tank 76.

Figure 22:
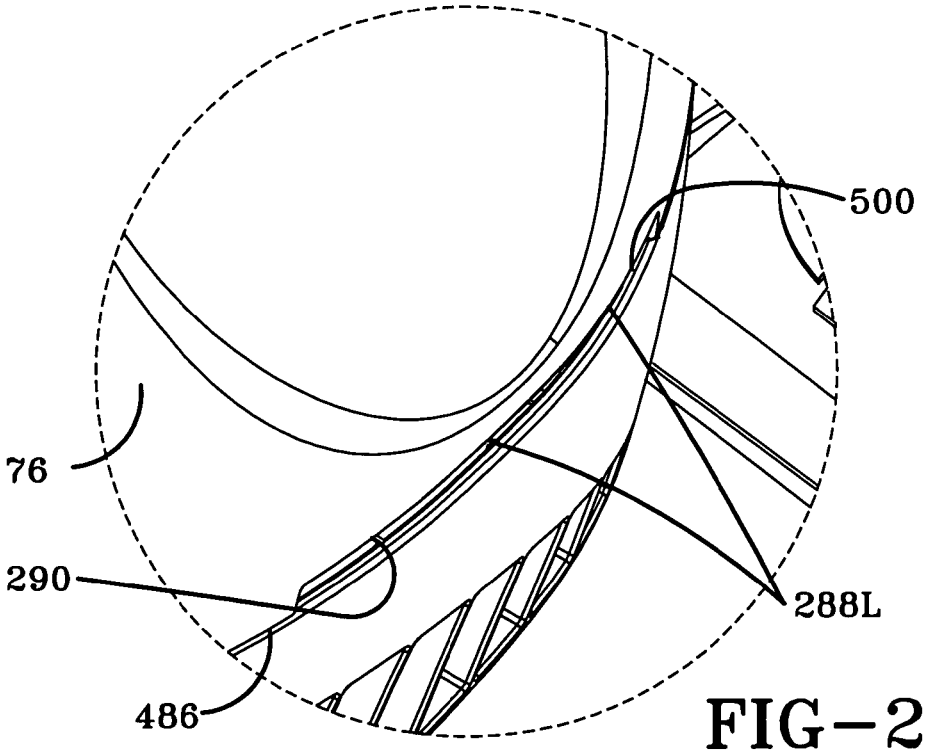
FIG. 22 is an enlarged perspective view of the portion of the carpet extractor as indicated in FIG. 1.

To removably mount the solution tank 76 with lid assembly 760 to the handle assembly, the solution tank 76 is positioned such that the groove 500 of the bottom wall 486 pivotally engages the upper ends 290 of the ribs 288L as seen in FIG. 22. The solution tank 76 is then pivoted towards the spine 292 until a pair of lateral hooks 502 integrally molded on the right sidewall 332 extend through apertures (FIG. 23) in the left half shell 294L of the spine 292 and releasably engage a left latch 506 connected to the spine 292. Also, with the solution tank 76 in this position, a recess 504 (FIG. 21) formed in the right sidewall 332 of the solution tank 76 receives a complementary integrally molded projection 505 in the left half shell 294L of the rear leg 298 of the spine 292 for additional support.

Figure 23:
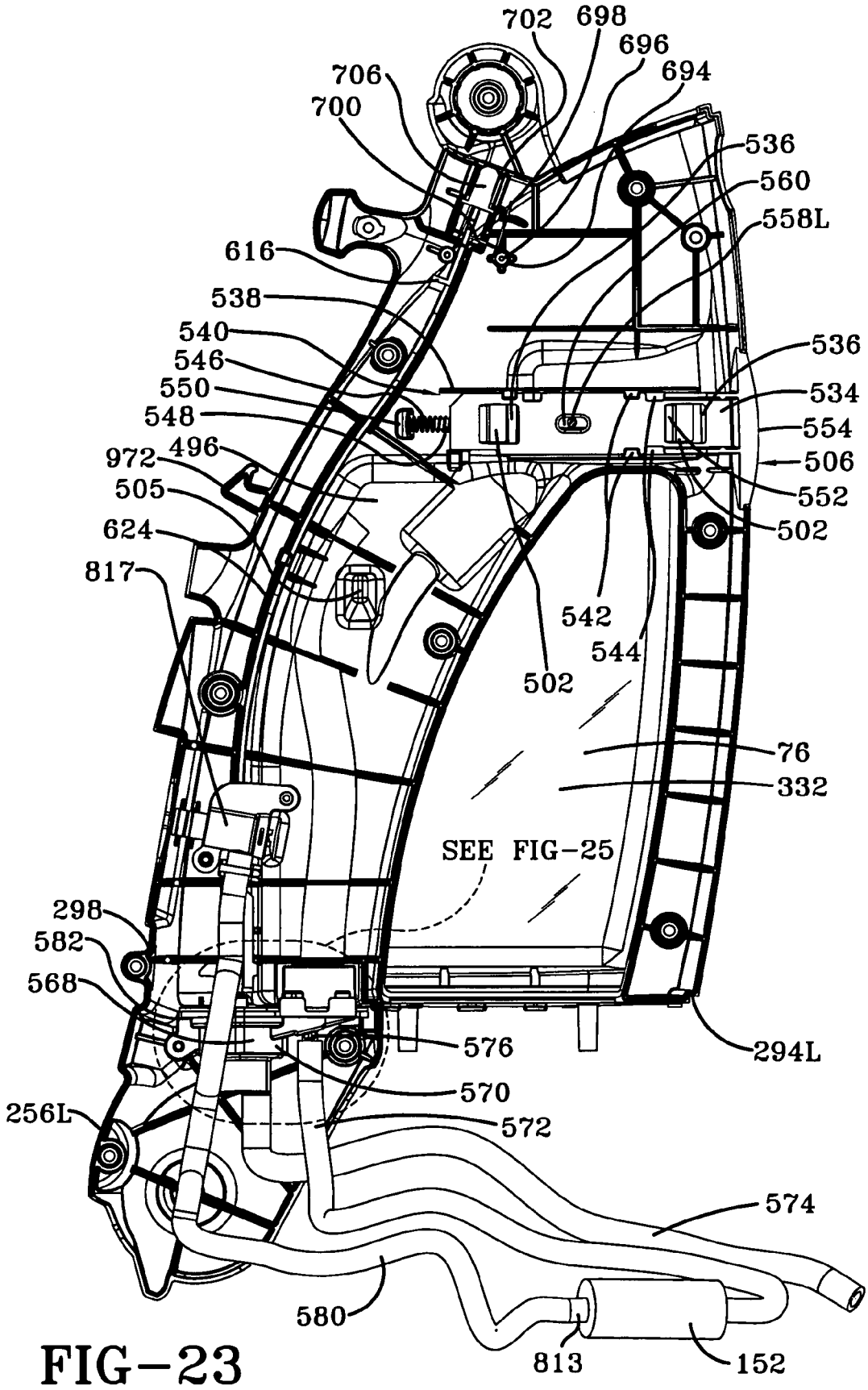
FIG. 23 is a right side view of the left portion of the lower handle body of the handle assembly for the carpet extractor of FIG. 1.

A latch arrangement 508 (FIG. 24) for releasably engaging the recovery tank 80 and solution tank 76 to the lower handle body 254 is mounted to the upper portion of the spine 292. The latch arrangement 508 includes a right latch 510 slidably mounted in a track 513 formed in the inner side of the right half shell 294R of the spine 292 for the recovery tank 80 as seen in FIGS. 14A and 14B, and a left similar latch 506 slidably mounted in a track 540 formed in the left half shell 294L of the spine 292 for the solution tank as seen in FIG. 23. Turning to FIG. 14A, the recovery tank latch 510 comprises a generally rectangular latch body 512 having a pair of square openings 514. Integrally molded to the inner side of the right half shell 294R are track rails 516 with four integrally molded retaining plates 518, which extend partially over the latch body 512, to retain the latch body 512 to the track 513. The latch body 512 is assembled to the right half shell 294R by aligning and inserting the retaining plates 518 through complimentary notches 520 formed on opposite ends of the latch body 512. A metal coiled spring 522 mounts around a pin 524, which is integrally molded to the rear side of the latch body 512, and seats in a pocket of a retainer 526, which is integrally molded to the right half shell 294R.

When mounting the recovery tank 80 to the handle assembly 62, the beveled rearwardly facing noses 528 of the two hooks 340 cam against their respective rear edges of the openings urging the recovery latch 510 rearwardly until the noses 528 extend through the openings 514 and engage the latch body 512 as shown in FIG. 14A. The spring 522 forwardly biases the latch body 512 urging it to maintain engagement with the hooks 340 of the recovery tank 80, thereby preventing removal of the recovery tank 80. A semi-circular push button 530 is integrally molded to the front side of the latch body and extends through a complimentary opening formed in the front side 532 of the right half shell 294R for access by a user. To release the latch 510 from engagement, a user pushes rearwardly on the push button 530 to slide the latch 510 rearwardly a sufficient distance to disengage the hooks 340 from the latch body as seen in FIG. 14B. This action allows removal of the recovery tank 80 from the handle assembly 62.

Referring to FIG. 23, the solution tank latch 506 comprises a generally rectangular latch body 534 having a pair of square openings 536. Integrally molded to the inner side of the left half shell 294L are track rails 538 with four integrally molded retaining plates 542, which extend partially over the latch body 534, to retain the latch body to the track 540. The latch body 534 is assembled to the left half shell 294L by aligning and inserting the retaining plates 542 through complimentary notches 544 formed on opposite ends of the latch body 534. A coiled metal spring 546 mounts around a pin 548, which is integrally molded to the rear side of the latch body 534, and seats in a pocket of a retainer 550, which is integrally molded to the left half shell 294L. When mounting the solution tank 76 to the handle assembly 62, the beveled rearwardly facing noses 552 of the two hooks 502 cam against their respective rear edges of the openings 536 urging the latch 506 rearwardly until the noses 552 extend through the openings 536 and engage the latch body 534. The spring 546 forwardly biases the latch body 534 urging it to maintain engagement with the hooks 502 of the solution tank 76, thereby preventing removal of the solution tank 76. A semi-circular push button 554 is integrally molded to the front side of the latch body 534 and extends through a complimentary opening formed in the front side 556 of the left half shell 294L for access by a user. To release the latch from engagement, a user pushes rearwardly on the push button 554 to slide the latch 506 rearwardly a sufficient distance to disengage the hooks 502 from the latch body 534 in a similar manner as that shown for the recovery tank latch 510 depicted in FIG. 14B. This action allows removal of the solution tank 76 from the handle assembly 62.

A pair of stop pins 558L, 558R, integrally molded on opposite sides of the elbow duct 306, extend into respective central slots 560, 562 formed in the latch bodies 534, 512 and cooperate to limit sliding movement of the latches to the range defined by the length of the slots 560, 562. In particular, the pins 558L, 558R and forward ends of the slots 560, 562 prevent the latches 506, 510 from sliding rearwardly to a position in which the retaining plates 542, 518 align with the notches 544, 520, causing the latch bodies 534, 512 to possibly disengage from the tracks 540, 513.

Figure 24:
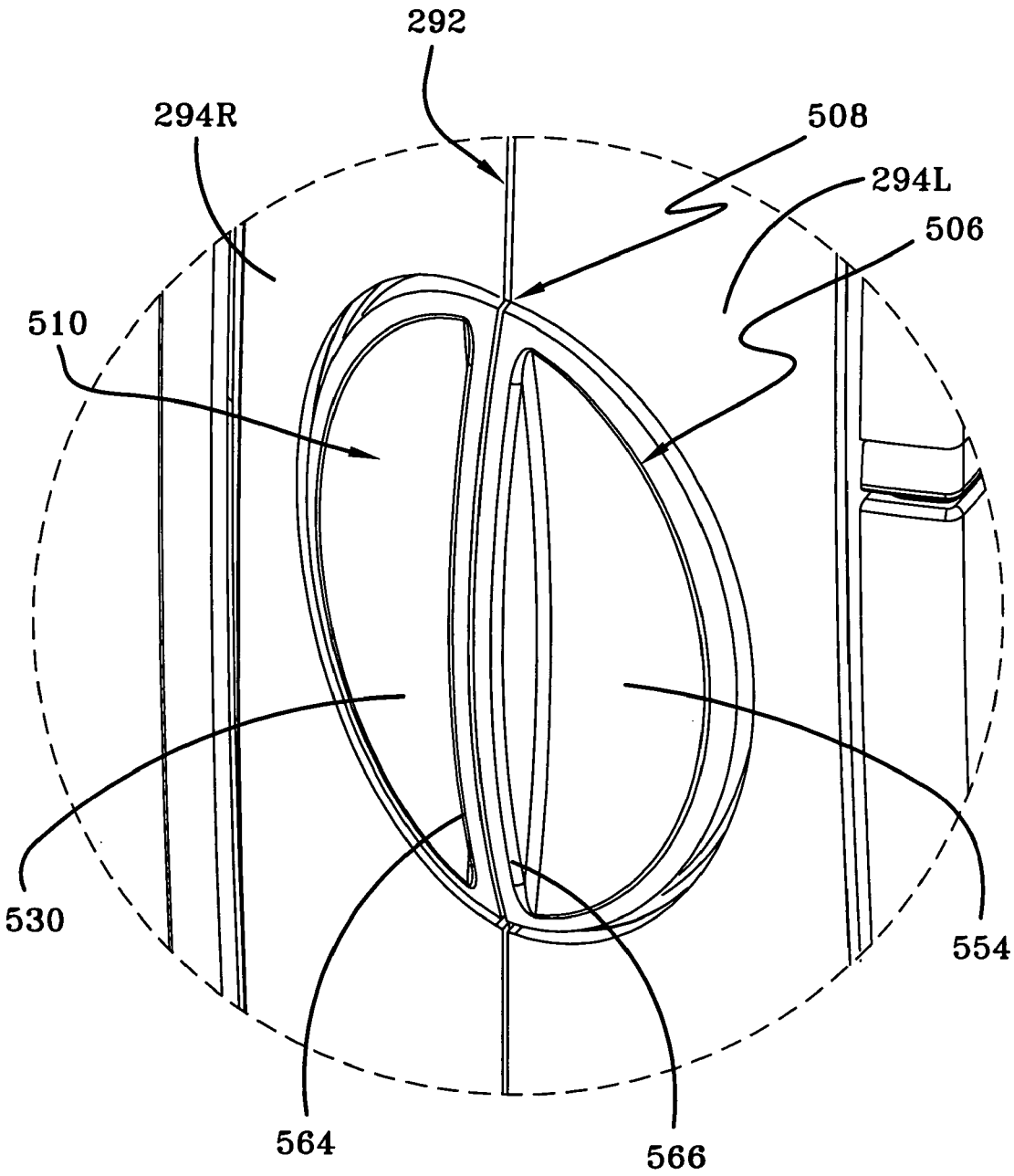
FIG. 24 is an enlarged perspective view of the portion of the carpet extractor as indicated in FIG. 1.

Referring to FIG. 24, when the right and left half shells 294R, 294L are mounted to each other to form the spine 292, the straight inner ends of the semicircular push buttons 530, 554 are positioned adjacent each other, and thus the buttons 530, 554 together form an aesthetic circular shaped. Integrally molded to the straight inner end of the push buttons 530, 554 are respective forwardly extending ribs or partitions 564, 566 that delineate their respective push buttons 530, 554, so that a user can easily distinguish between the two push buttons. The partitions 564, 566 also prevent the thumb or finger of a user, placed on the push button adjacent its partition, from inadvertently crossing over and pushing also on the other push button. However, if desired, a user can place his thumb or finger on the partitions 564, 566 and push both push buttons 530, 554 to simultaneously release both of the tanks 76, 80. A user can also push both push buttons using two fingers or thumbs. In this respect, the compact latch arrangement can be selectively operated to release or disengage the recovery tank 80 from the handle assembly 62, or release or disengage the solution tank 76 from the handle assembly 62, or release or disengage both the solution and recovery tanks 76, 80 from the handle assembly 62 at the same time.

As seen in FIG. 23, a cleaning solution reservoir assembly 568 is mounted to the left half shell 294L of the rear leg 298 and surrounded by the left half of the platform. The reservoir 568 receives and holds a quantity of cleaning solution from the solution tank 76 for distribution to supply tubes 572 and 574 as further described below. Upon assembly of left half shell to the right half shell, the left half of reservoir 568 protrudes through the left platform half 282L and left half shell 294L. Cleaning solution reservoir 568 includes a bottom concave basin 570 having two supply tubes 572 and 574 exiting therefrom. The supply tube 572 is fluidly connected to the inlet of the pump 152. Supply tube 572 provides a direct supply of cleaning solution, through discharge port 576, from reservoir 578 (FIG. 25) to the pump assembly 152, which pressurizes the cleaning solution and draws it to through the cross over solution tube 580 for the above floor cleaning. Supply tube 574 provides a valved release of cleaning solution from reservoir 578 to the inlet 105 (FIG. 5) of cleaning solution distributor 107 (FIG. 5) and then to the brush assembly 70 (FIG. 5). Optionally, the cleaning solution can be heated by a heater before being distributed on the surface. Also, an additional clean water tank may be incorporated into the system.

Figure 25:
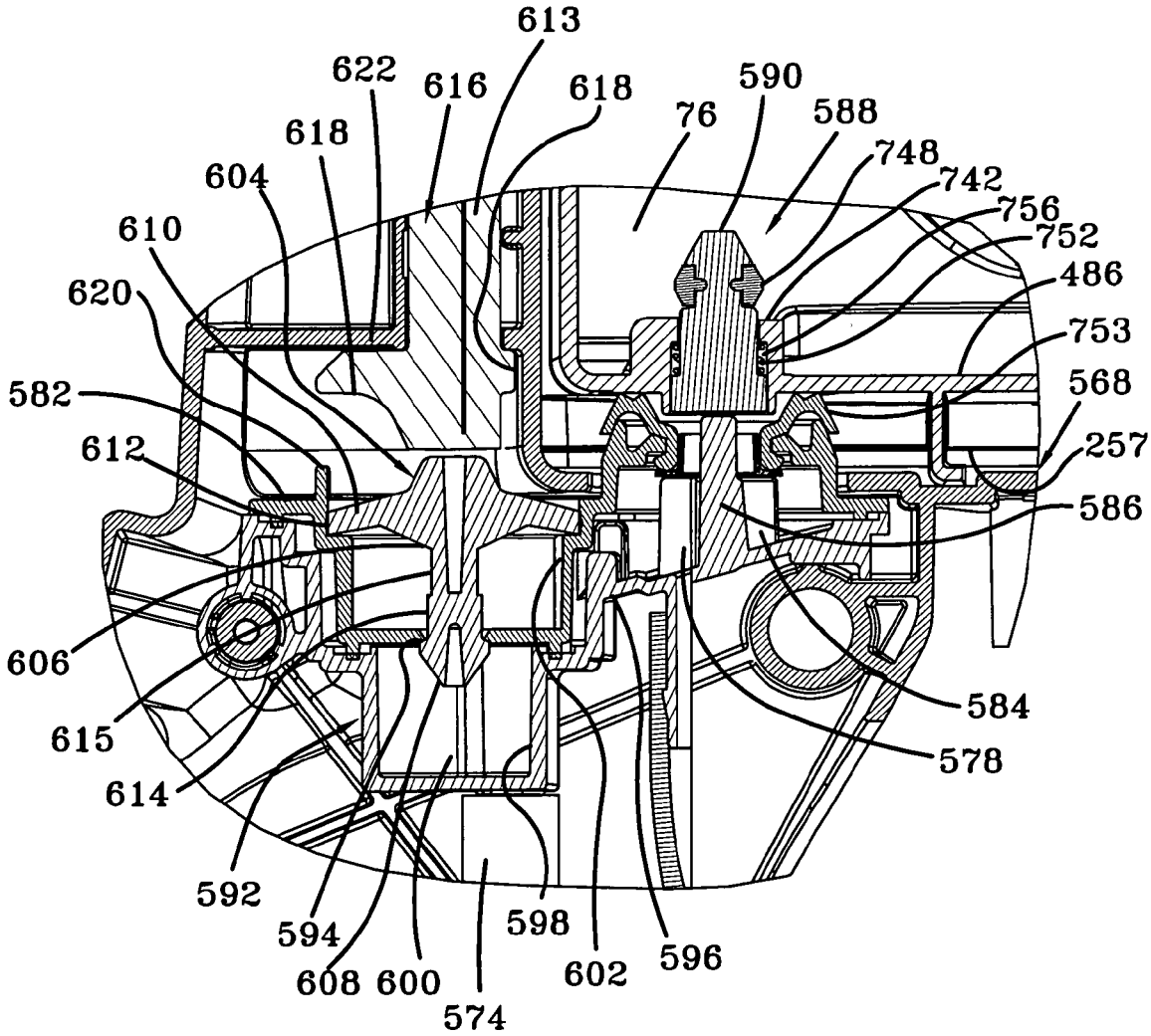
FIG. 25 is a right side section view of the portion of the carpet extractor as indicated in FIG. 23.

Referring to FIG. 25, cover plate 582 is sealingly attached to basin 570 thereby forming reservoir volume 578 which the solution tank 76 floods with cleaning solution through inlet port 584. Extending axially upward through inlet port 584 is pin 586 which acts to open solution tank valve 588 of the solution tank 76 as tank 76 is placed upon the left platform half 282L and secured in place. The engagement of the left spine projection 505 (FIG. 23) and tank recess 504 (FIG. 21) also ensures that the pin 586 is aligned with a plunger 590 of the solution tank valve 588 and pushes the plunger 590 a sufficient distance to open the valve 588. The structure and operation of solution tank valve 588 is described further below.

Cleaning solution is released, upon operator demand, into tube 574 through solution release valve 592 which comprises valve seat 594 positioned in basin 596 of bowl 598 integrally formed with top cover 582. The basin 596 of bowl 598 extends across discharge port 600 such that valve seat 594 is aligned to open therein. An opening 602, within the wall of bowl 598, permits the free flow of cleaning solution from reservoir 568 into bowl 598. An elastomeric valve member 604 comprises an elongated piston 606 extending through valve seat 594 having a bulbous nose 608 at the distal end thereof within discharge port 600. Valve member 604 is preferably made from Advanced Elastomer Systems "SANTOPRENE" 201-55 elastomeric material.

The opposite end of piston 606 includes a downwardly sloped circular flange 610, the peripheral end of which frictionally and sealingly engages the upper circular rim 612 of bowl 598 thereby preventing leakage of cleaning solution thereby. The elongated piston 606 is generally divided into three sections 608, 614, 615 of different diameters that correspond to different flow rates. The lower bulbous nose 608 is the largest diameter, followed by the middle section 614 and then the upper section 615 adjacent the flange 610. Without any downward force upon it, flange 610 acts to bias piston 606 upward thereby urging nose 608 into sealing engagement with valve seat 594 preventing the flow of cleaning solution from bowl 598 into discharge port 600 and tube 574.

The solution release valve 592 is operated by pressing downward upon the elastomeric release valve member 604 by lower end 613 of lower push rod 616 thereby deflecting the center of flange 610 downward urging nose 608 downward and away from valve seat 594 permitting the passage of cleaning solution therethrough into discharge port 600 and tube 574 at one of two selected flow rates depending on which section of the piston is spaced from the valve seat 594. The manner and mechanism for selecting the flow rate will be explained later. Limit projections 618 integrally molded on the lower end of lower push rod 616 will abut an opposing stop member 620 on the solution release valve to limit downward movement of the lower push rod. The limit projections 618 will abut an opposing stop member 622 on the left half shell 294L of the spine 292 to limit upward movement of the lower push rod 616. Energy stored within flange 610, as a result of being deflected downward will, upon release of the force applied to push rod 616, return the 592 valve to its normally closed position as illustrated in FIG. 25.

Referring now to FIG. 23, extending upwardly and slidably received in a track 624 formed along the rear leg 298 of the left half shell 294L of the spine 292 is the articulated lower push rod 616. The lower push rod 616 is generally flexible to conform to the curved track 624. In that regard, the rod 616 is composed of any suitable flexible material, such as, for example polypropylene. The lower end 613 is thicker or of a larger size than the rest of the lower push rod 616 so that it generates a pushing force that is spread evenly across the upper end of the flange 610. A torsion spring 694 biases the lower rod 616 upwardly so that the valve 592 is closed. In particular, a pin 696, integrally formed with left half shell 294L rotatably receives the spring 694, which has one end leg 698 secured to the left half shell 294L and the other end leg 700 secured to the lower rod 616 to urge the rod 616 upwardly.

Figure 26:
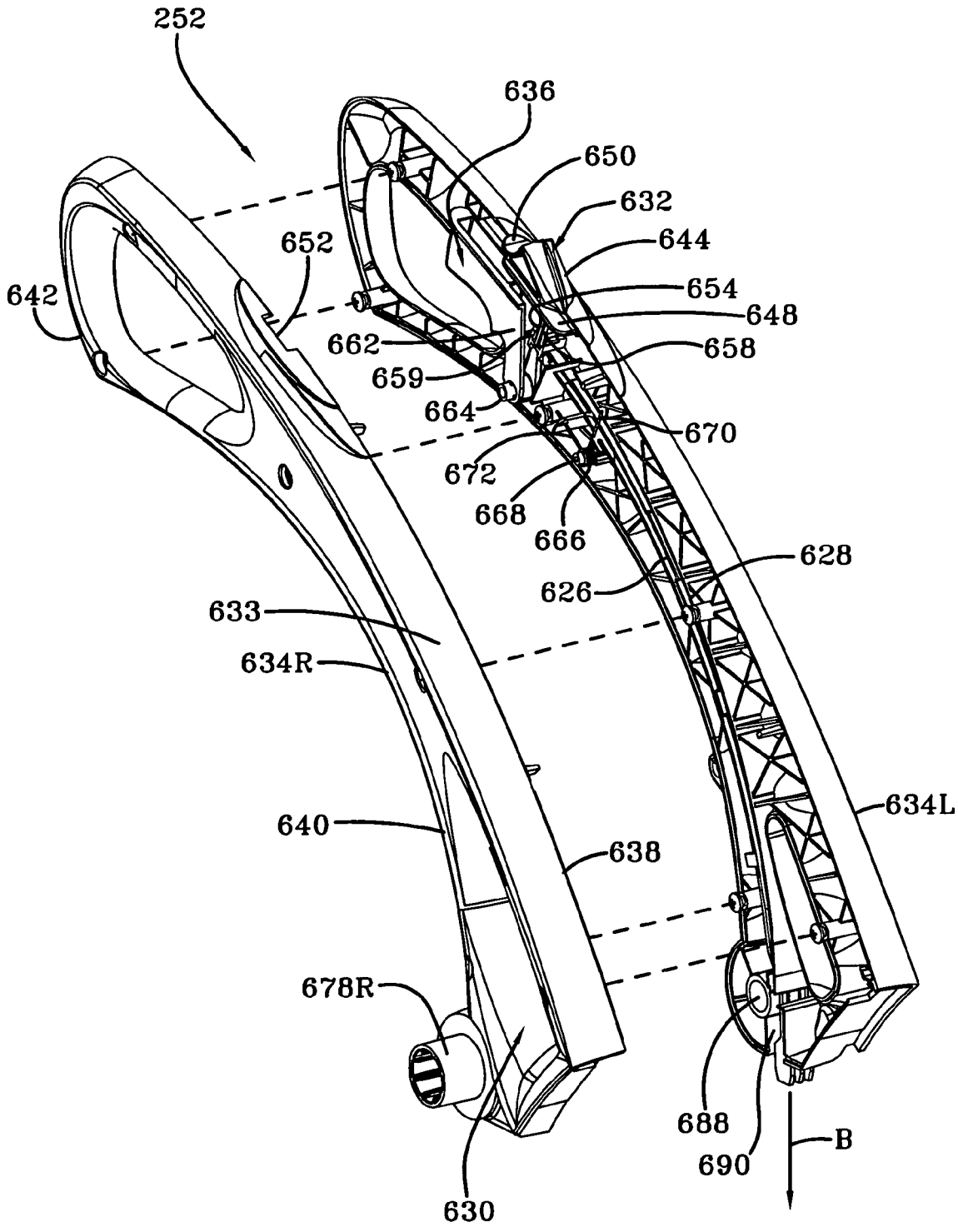
FIG. 26 is a perspective view of the upper handle portion of the handle assembly with the right half shell exploded away.
Figure 27:
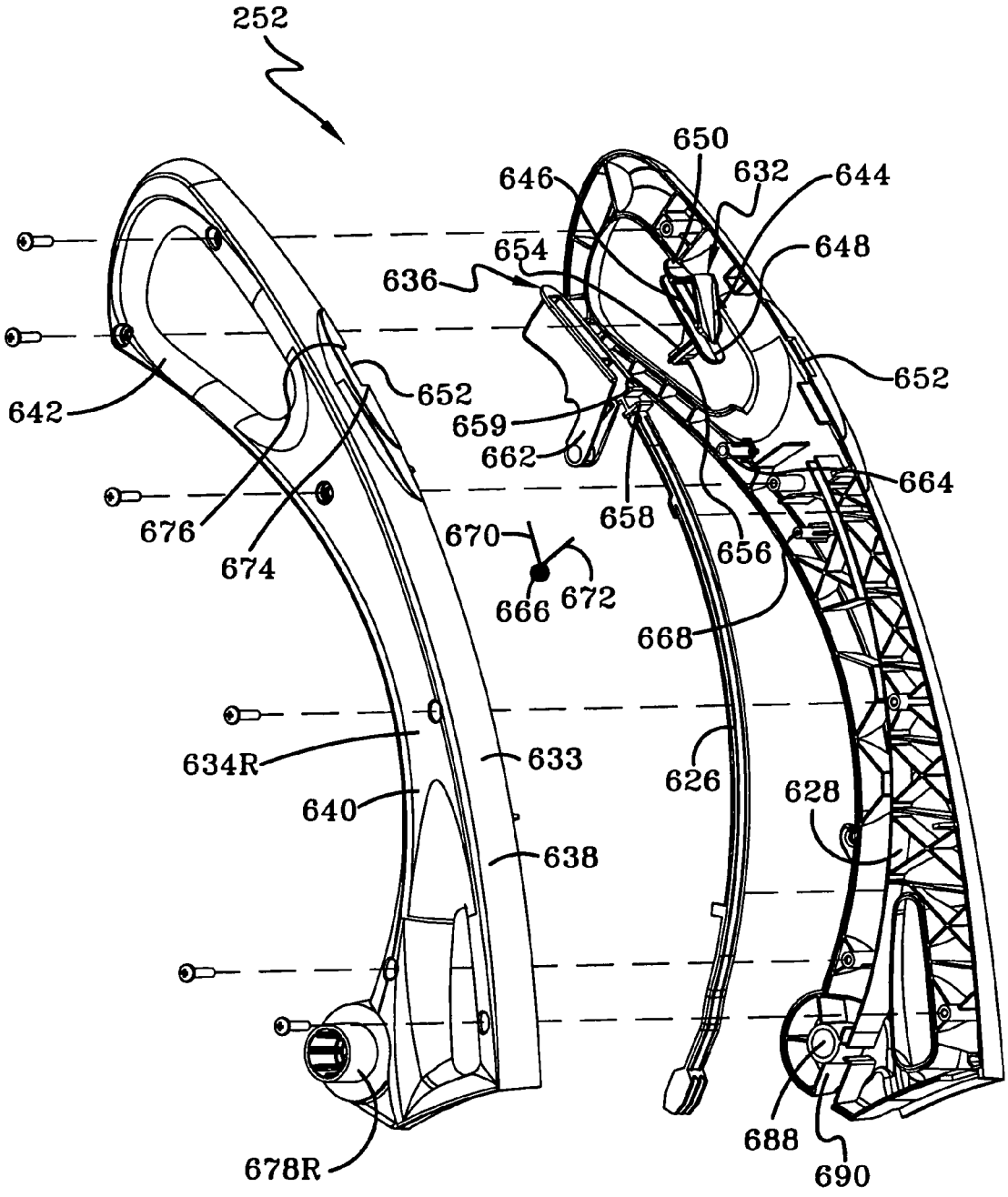
FIG. 27 is an exploded view of the upper handle position of the handle assembly of the carpet extractor of FIG. 1

As depicted in FIGS. 26 and 27, a similar flexible upper push rod 626 pushes against the lower push rod 616 when operated by a trigger 636 or a slide button 632 to move the upper push rod 626 down as indicated by arrow B. The upper push rod 626 is slidably received in a track 628 formed in the upper handle portion 252 of the handle assembly 62. The upper handle portion 252 includes a left half shell 634L mounted to a right half shell 634R. A lateral opening is formed at the lower portion of the upper handle defined a looped portion 630 with front and rear legs 638, 640 for grasping by a user. The track 628 is formed inside the left half shell 634L, extending upwardly from the rear leg 640 of the upper handle portion 252 to a loop hand grip 642. The loop hand grip 642 of the upper handle portion 252 is for grasping by the hand of a user to move the carpet extractor over the cleaning surface 74. The upper handle portion 252 is generally concavely curved, when viewed from the rear, such that the arm and hand of a user placed on the hand grip 642 is positioned in a more natural pushing and pulling position, thereby requiring less effort by the user to push and pull the carpet extractor over the cleaning surface when the handle assembly 62 is inclined and the upper handle portion 252 is folded up. The upper push rod 626 is generally flexible to conform to the curved track 628. In that regard, the upper rod 626 is composed of any suitable flexible material, such as, for example polypropylene.

The upper end of push rod 626 is connected to slide button 632, which is slidably mounted to the front side 633 of the upper handle portion 252. The slide button 632 includes integral head button portion 644, neck 646 (FIG. 27), and body 648. The head portion 644 has a concavely curved upper side 650 for receiving a thumb of a user to slide the slide button 632 down. The neck 646 extends through a slot disposed in the front side 633 of the upper handle portion 252 with the head button portion 644 located on the front side 633 and the body 648 located just underneath it. The length of the slot 652 between its upper and lower ends 676, 674 defines the range of sliding movement of the slide button 632. An L shaped leg 654 depends downwardly from the body 648 and together with the body 648 defines a notch 656 (FIG. 27) that receives the upper push rod 626. The leg 654 seats between a pair of integrally molded upper and lower retaining plates 658 of the upper push rod 626, which together with the right and left half shells 634R, 634L retain the slide button to the upper push rod 626. Thus, sliding the slide button 632 down in turn causes the upper and lower rods 626, 616 to slide down too.

The trigger 636 is pivotally connected to the left half shell 634L and cams against the upper retaining plate 659 to push the upper push rod 626, when the trigger 636 is squeezed by a finger of a user. In particular, an integral front leg 662 of the trigger 636 depends downwardly and includes a pivot opening at its lower portion that receives a pivot pin 664, integrally to the left half shell 634L. The upper portion of the front leg 662 cams against the upper retaining plate 659 and pushes the upper push rod 626 down, when the trigger 636 is squeezed. A torsion spring 666 is mounted around an integral boss 668 of the left half shell 634L and has one end leg 670 secured to the upper push rod 626 and the other end leg 672 secured to the left half shell 634L. The spring 666 urges the upper push rod 626, slide button 632, and trigger 636 upwardly or towards the looped hand grip 642 and valve closed mode as illustrated in FIG. 26. The springs 666, 694 are engineered to support the combined weight of trigger 636, slide button 632, and push rods 616, 626 such that no force is applied to elastomeric valve member 604.

Referring to FIGS. 23, 25, and 26, upon the operator squeezing the hand grip 642 and trigger 636 with his finger, the torsion springs 666, 694 yield thereby permitting clockwise rotation of trigger 636 (as viewed from the left side) about pivot pin 664 and downward movement of push rods 616, 626, which push the elongated piston 606 down a predetermined distance so that the middle portion 614 of the piston 606 extends through the valve seat 594 and is spaced from the edges of the valve seat 594. This results in opening the solution release valve 592, causing gravitational flow of cleaning solution from reservoir 568 to tube 574 at a normal flow rate. Upon release of trigger 636 or slide button 632, energy stored in the system returns valve 592 to the closed mode.

Upon the operator sliding the slide button 632 down until the neck 646 abuts the lower end 674 of the slot 652, the torsion springs 666, 694 yield thereby allowing the upper and lower rods 626, 616 to push the elongated piston 606 down a predetermine distance further than that accomplished by squeezing the trigger 636, so that the upper portion 615 of the piston extends through the valve seat 594 and is spaced from the edges of the valve seat 594. With the piston 606 in this position, the lateral distance between the upper portion 615 and valve seat 594 is larger than that between the middle portion 614 and valve seat 594, thereby allowing more cleaning solution to flow to reservoir 568 and to the tube 574. Thus, the cleaning solution flows between the upper portion 615 and valve seat 594 at a higher flow rate than that between the middle portion 614 and valve seat 594. Alternatively, an operator could slide the slide button 632 down a predetermine distance so that the middle portion 614 is spaced from the valve seat 594 to obtain a normal flow rate cleaning solution. Upon release of the slide button 632, energy stored in the system returns the valve 592 to the closed position.

The upper handle portion 252 releasably locks to the lower handle body 254 for use and folds down behind the lower handle body 254 for storage as seen in FIG. 11. In particular as best seen in FIG. 9, the upper handle portion 252 includes trunnions 678L, 678R that are enclosed by caps 680L, 680R integrally molded to the rear upper end of the spine 292 and located on opposite sides of the spine 292. The right cap 680R has an inward extending pin 684 that is telescopingly received in an inward extending boss 686. A bore 688 (FIG. 26) formed through the trunnions 678R, 678L receives the pin 684 and boss 686, thereby pivotally connecting the upper handle portion 252 to the lower handle body 254. The upper push rod 626 extends through an aperture 690 (FIG. 26) in the bottom side of the left half shell 634L of the upper handle portion 252. The lower push rod 616 extends through an aperture in the top surface of the left half shell 294L of the spine 292.

Figure 28:
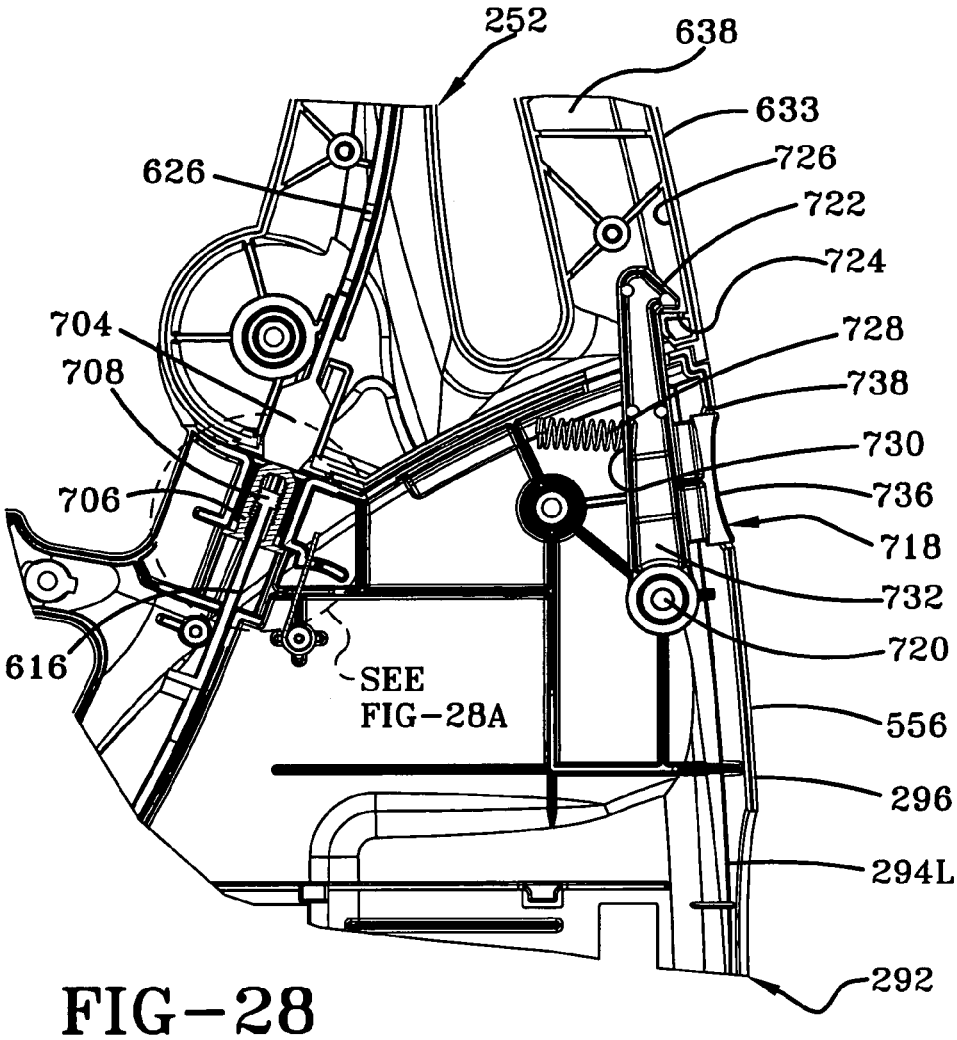
FIG. 28 is a partial sectional view taken along line 28-28 of FIG. 1.
Figure 28A:
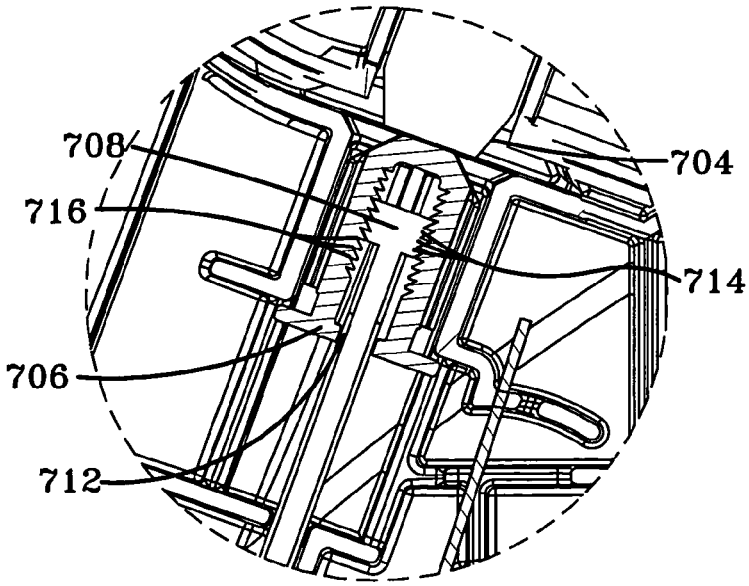
FIG. 28A is an enlarged section view of the portion of the carpet extractor indicated in FIG. 28.

Referring to FIG. 28, when the upper handle portion 252 is pivoted up to the upright position, the bulbous lower end 704 of the upper push rod 626 is aligned with an adjustable spacer 706 removably secured to the upper end 708 of lower push rod 616. The spacer 706 is adjusted to be spaced at the proper alignment and distance below the lower end 704 of the upper push rod 626 so that the rods 616, 626 cooperate to push the piston 606 (FIG. 25) to one of the above-mentioned predetermine distances corresponding to the cleaning solution flow rate. In particular as depicted in FIG. 28A, the spacer 706 includes a notch 712 disposed on the bottom side that receives the upper end 708 of the lower push rod 616. The upper end 708 has a multiple rows of circumferential ribs or threads 714 that are slidably receive by complimentary grooves 716 formed around the notch 712 to secure the spacer 706 to the upper end 708. The spacer 706 can be adjusted closer to the lower end 704 of the upper rod 626, by aligning and sliding spacer on the upper end 708 at a position higher than the previous position.

As depicted in FIG. 28, a push button latch 718 releasably latches or locks the upper handle portion 252 to the lower handle body 254. The latch 718 includes an opening at its lower end of its body that rotatably receives a pivot pin 720 integrally molded to the left half shell 294L of the spine 292 to pivotally connect the latch to the front spine leg 296. The latch 718 includes an upwardly extending hook 722 that engages or hooks upon a rearwardly extending rib 724, integrally molded on the inner surface 726 of the front side 633 of the upper handle. A coiled metal spring 728 has one end securely seated in a pocket 730 formed in the rear side of the latch body 732 and the other end mounted around a pin 735 (FIG. 14A) of a retainer 734 (FIG. 14A), which is integrally molded to the right half shell 294R of the spine 292. The spring 728 forwardly biases the hook 722 urging it to maintain engagement with the rib 724, thereby preventing the upper handle portion 252 from folding or pivoting down. A circular push button 736 is integrally molded to the front side of the latch body 732 and extends through a complimentary opening 738 formed in the front side 556 of the spine 292 for access by a user. The right half shell 294R of the spine captures the latch to retain it and also forms part of the opening 738.

To release the latch 718 from engagement, a user grasps around the front leg 638 of the upper handle 252 and pushes rearwardly on the push button 736 to pivot the latch 718 rearwardly a sufficient distance such that the hook 722 disengages from the rib 724. This action allows the upper handle portion 252 to be pivoted or folded down behind the lower handle body 254 for storage as seen in FIG. 11.

Referring to FIG. 25, the solution tank valve 588 is provided in the solution tank for releasing solution from the solution tank. The solution tank valve 588 is normally in the closed position. However, as the solution tank is placed upon the reservoir 568, the solution tank valve 588 opens permitting cleaning solution to flow into the reservoir 568. Upon removal of the tank 76 from the reservoir 568, the solution tank valve 588 closes prohibiting liquid from flowing out of the solution tank 76. The solution tank valve 588 is incorporated into bottom wall 486 of the solution tank 76. The solution tank valve 588 comprises a valve body 742 with the elongate plunger 590 extending coaxially upward therethrough. The plunger 590, having an outside diameter less than the inside diameter of the valve body 742, is provided with at least four flutes 745 (FIG. 21) to maintain alignment of the plunger 590 within the valve body 742 as the plunger 590 axially translates therein and permits the passage of fluid therethrough when the plunger 590 is in the open position.

The valve body 742, integrally formed with the bottom wall 486 of the solution tank 76, has a vertically extending bore 756 that slidingly receives therein the upper shank portion of the plunger 590. An elastomeric circumferential seal 748 circumscribes plunger 590 for sealingly engaging valve body 742. The seal 748 is urged against the valve body 742 by action of the compression spring 752, circumscribing plunger 590. The spring 752 is positioned between the body 742 and the plunger 590. The solution tank valve 588 is normally in the closed position. However, as the solution tank 76 is placed upon the left platform 282L of the handle assembly 62, pin 586 of the reservoir 568 aligns with plunger 590, thereby forcing plunger 590 upward to separate the seal 748 from the valve body 742 and compressing spring 752, thereby opening the valve body 742 permitting cleaning solution from the solution tank to flow through bore 756 of the valve body 742 into the reservoir 568. Also, a seal 753, mounted on the top cover 582 of the reservoir 568 and surrounding the pin 586, sealingly engages the bottom wall 486 of the solution tank 76 when the tank 76 is mounted on the left platform 282L. Upon removal of the solution tank 76 from the left platform 282L, the energy stored within compression spring 752 urges the seal 748 down against the valve body 742 to close the valve 746.

Figure 21:
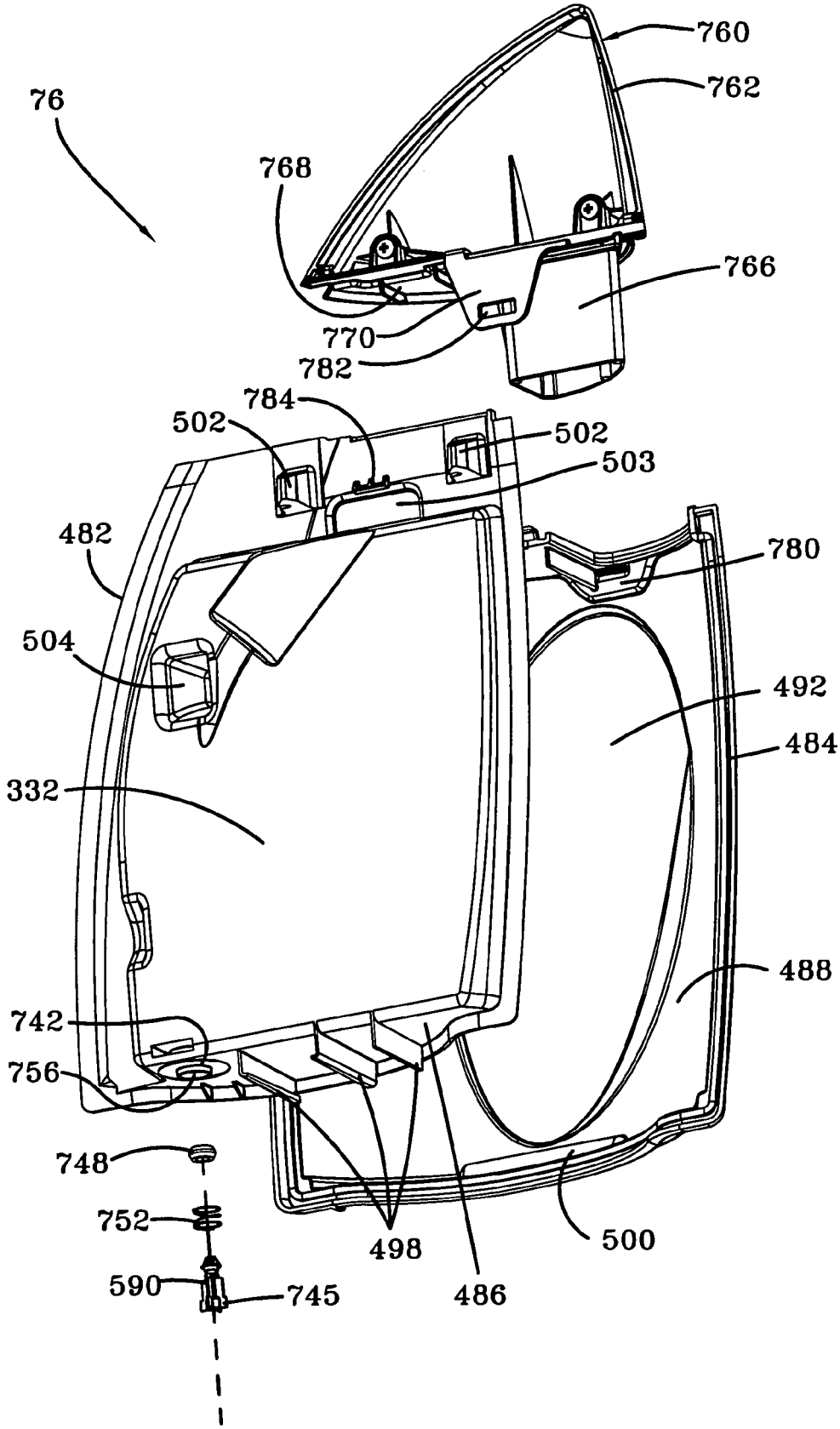
FIG. 21 is an exploded view of the solution tank assembly of the carpet extractor of FIG. 1.

Referring to FIG. 21, the solution tank 76 includes an open top sealingly closed by a lid assembly 760. The lid assembly 760 includes a generally triangular shaped body 762 with its convexly curve left side 764 (FIG. 9) converging upwardly to an apex. The lid assembly incorporates an inverted cup portion 766 depending downwardly from the bottom wall 768 of the body 762, which serves as a convenient measuring cup for mixing an appropriate amount of concentrated cleaning solution with water in the solution tank 76. Similar to the recovery tank lid assembly 324, the solution tank lid assembly 760 includes a right tab 770 and a left tab 772 (FIG. 10) to removably mount the lid assembly 760 to the top of the tank 76. In particular as depicted in FIG. 10, the left tab 772 is integrally formed with the left side 774 of the lid body 762 and depends downwardly from the lower end of the body 762. The left tab 772 fits into a complementary recess 780 (FIG. 21) of the left wall 488 of the solution tank 76 and has a slot 776 that receives a complementary rib 778 formed on a recess 780 (FIG. 21) to releasably secure the lid assembly 760 to the solution tank 76. Grasping and pulling the left tab 772 upwardly and outwardly disengages the slot 776 from the rib 778 thereby allowing the lid assembly 760 to be removed, if the right tab 770 is also disengaged from the solution tank 76.

Referring to FIG. 21, the right tab 770 is integrally formed with the left end of the bottom wall 768 and depends downwardly therefrom. The right tab 770 has a slot 782 that receives a rib 784 formed on the right sidewall 332 of the solution tank. The right tab 770 partially extends over a recess portion 503 formed in the right sidewall 332. The recess 503 provides access to grasp the tab by a finger or thumb of a user and also abuts the cup portion 766 of the lid assembly 760, thereby preventing deformation of the right sidewall 332 of the solution tank 76. Grasping and pulling the right tab 770 outwardly disengages the slot 782 from the rib 784 thereby allowing the lid assembly 760 to be removed, if the left tab 772 is also disengaged from the solution tank 76. The right and left tabs 770, 772 function together to properly seal the lid assembly 760 on the solution tank 76. Alternatively, the lid assembly 760 could include only one of the right and left tabs 770, 772 to removably mount the lid assembly 760 to the solution tank 76. Further, a reversal of these parts could be present in that the solution tank 76 includes the tabs and the lid assembly 760 includes the recesses and ribs.

Figure 29:
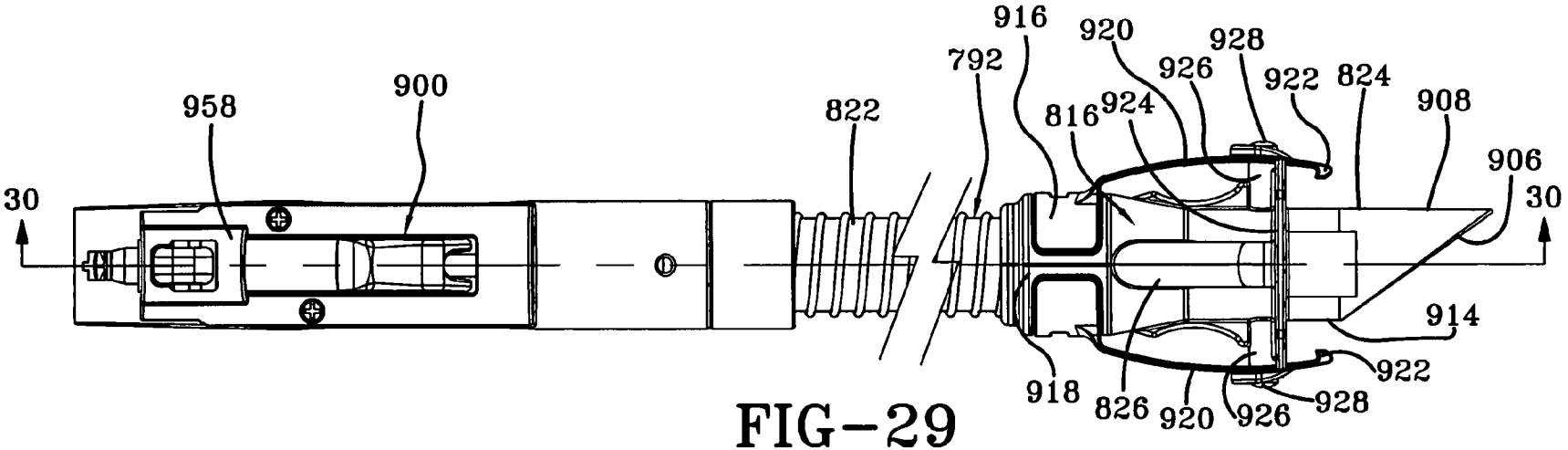
FIG. 29 is a side view of the accessory hose assembly.

The arrangement for above the floor or upholstery cleaning will now be described. As depicted in FIGS. 14A and 14B, integrally molded to the main recovery duct 304 is an accessory duct 786 that extends to an opening in the rear side 788 of the rear leg 298 of the right half shell 294R of the spine 292. The accessory duct 786 includes an inlet 790 (FIG. 10) for fluid connection to an accessory hose assembly 792 (FIG. 29). A door 794 is pivotally connected to the rear side 788 of the right half shell 294R of the spine 292. Specifically, the rear side 788 includes a land portion 796 with a recess 798 in which the opposite sides of the recess have apertures that receive trunnions 800 (FIG. 9) on the door 794 to form the pivotal connection.

Integrally formed on the top surface of the door 794 are a pair of stop ribs 802 that frictionally engage the bottom of the recess 798 to keep the door 794 from falling or pivoting down due to gravity as seen in FIG. 14A. The bottom end of the door has a convexly or curved portion that defines a handle 804. A forward depending hook 806 is integrally molded on the front surface of the door 794 just above the handle 804. The door 794 includes an inner circular wall 810, integrally molded to the front or inner side of the door 794, that extends forwardly into inlet 790 of the accessory duct 786, when the door covers the opening in the closed position as seen in FIG. 14B. An outer circular wall 808 (FIG. 9), integrally molded to the rear side and concentric with the inner circular wall 810, surrounds the inner circular wall 810 and extends forwardly a smaller distance than the inner wall 810. A seal 812 is sealingly inserted around the accessory duct 786, and sealingly engages the outer wall 808 and around the inner circular wall 810, when the door 794 is closed as seen in FIG. 14B. Thus, when the door 794 closes over the inlet 790 of the accessory duct 786, particles and atmospheric air are prevented from entering the inlet 790. Also, when the door 794 is closed, the hook 806 extends into a slot 814 (FIG. 10) formed in the rear side 788 of the right half shell 294R and engages the inner surface of the rear side 788 to releasably latch the door 794.

To open the door 794 for connection of an accessory hose assembly 792, a user grasps the handle 804 and pulls with sufficient force to disengage the hook 806 from the inner surface of the rear side 788 and pivots the door 794 upwardly until the stop ribs 802 frictionally engage the bottom side of the recess 798. The accessory hose assembly 792 cooperates with the inlet 790 of the accessory duct 786 so that the carpet extractor 60 can be used, for example, to clean upholstery and/or stairs.

Figure 30:
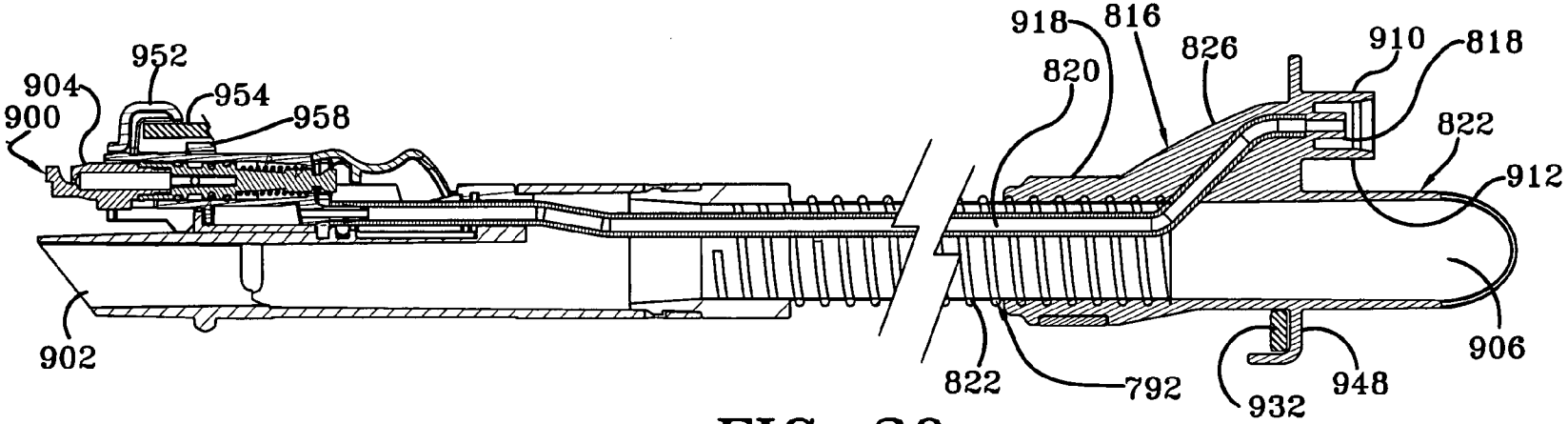
FIG. 30 is a sectional view taken along line 30-30 of FIG. 29 and also showing the ends of the hose assembly mounted to portions of the caddy.

As seen FIG. 14A, the accessory hose assembly 792 includes a hose connector assembly 816 that fluidly connects to the inlet 790 of the accessory duct 786 and cleaning solution discharge valve 817, which is fluidly connected to the solution cross over tube 580 in fluid connection to the discharge port 813 of the pump 152. As seen in FIG. 30, the hose assembly 792 includes a hose solution tube 820 that is received in a vinyl corrugated accessory suction hose 822. The hose connector assembly 816 encapsulates the suction hose 822 so that suction hose 822 is in fluid communication with a suction conduit 824 of the hose connector assembly 816. The hose solution tube 820 extends into the hose connector assembly 816 through a solution conduit 826. The solution conduit 826 is generally integrally molded with the suction conduit 824 of the hose connector assembly 816, but can alternatively be a separate piece secured to the suction conduit 824 by any suitable means such as for example, by welding or using screws.

Figure 31B:
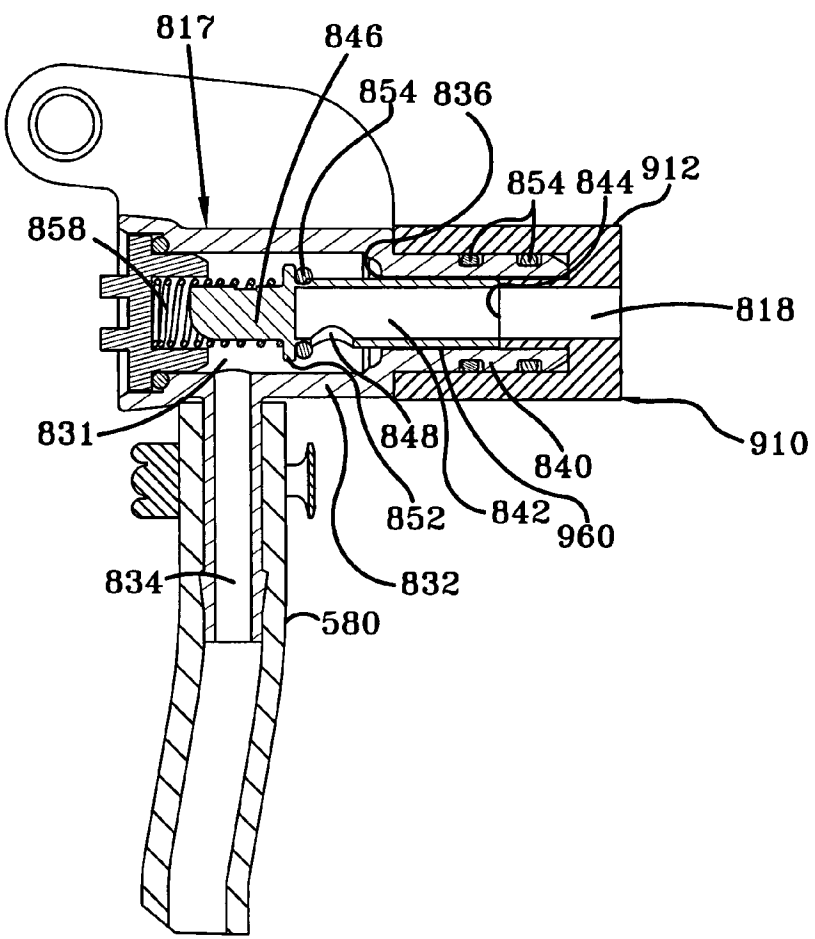
FIG. 31B is a view similar to FIG. 31A but with the solution discharge valve being in the open position.
Figure 31A:
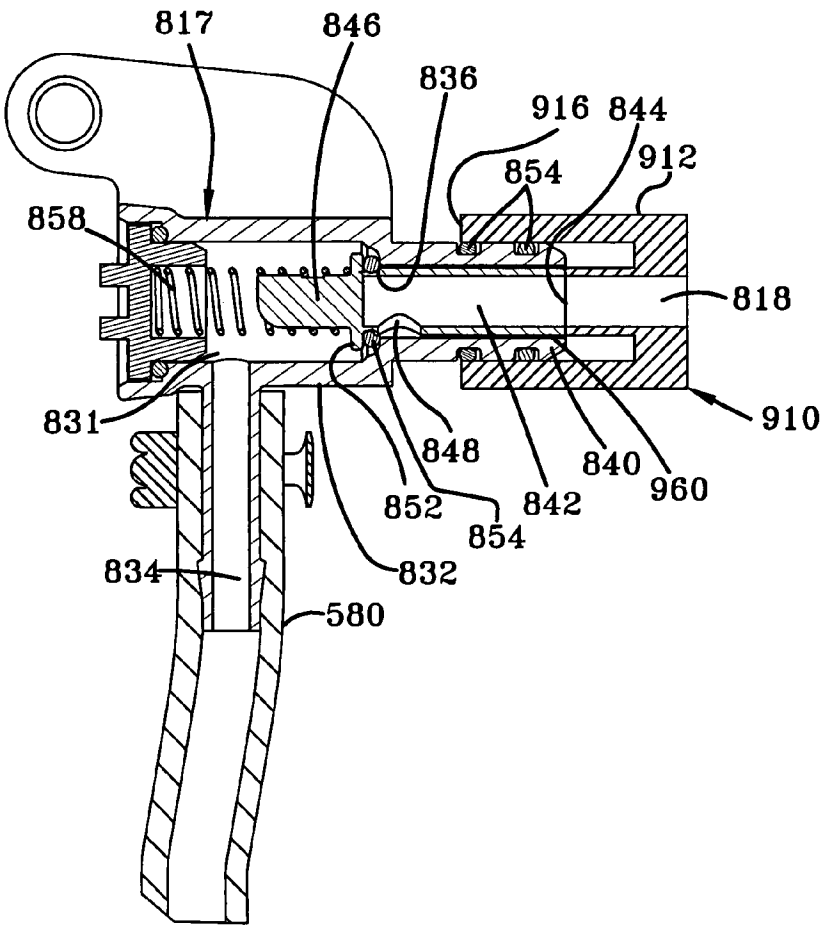
FIG. 31A is a left partial side sectional view of the solution discharge valve and quick disconnect assembly of the carpet extractor of FIG. 1.

Turning now to FIGS. 31A and 31B, the cleaning solution discharge valve 817 is mounted to the left half shell 294L (FIG. 23) and comprises a main body 832 having a downwardly directed inlet 834 and a rearwardly directed side outlet 836. Inlet 834 fluidly communicates with the discharge port 813 of pump 152 via cross over tube 580 whereby pressurized cleaning solution is supplied to the main body 832. Integral with and extending horizontally from main body 832 is discharge port 840 configured as a nipple for receiving thereon the cleaning solution supply hose quick disconnect coupling 910 further described below. The discharge port 840 extends to an opening 919 (FIG. 10) formed in the rear side of the left half shell 294L of the spine 292. Axially aligned within discharge nipple 840 is axially translatable valve member 842 having a hollow core open at outlet end 844 thereof and closed at inlet 846 and having at least one opening 848. Compression spring 858 acting upon circumferential flange 852 of valve member 842 biases valve member 842 toward the normally closed configuration as illustrated in FIG. 31A thereby sealingly compressing O-rings 854 between the main body 832 and flange 852.

Removably attachable to discharge nipple 840 is quick disconnect coupling 910. Coupling 910 comprises a main cylindrical body 912 having a peripheral rim 916 of the cylindrical main body 912. Closing off the opposite end of main body 912 is the axially extending tubulet 818 to which accessory solution supply tube 820 (FIG. 30) is fluidly connected. Tubulet 818 extends axially inside main body 912 which when the main body 912 receives nipple 840 therein, axially aligns with valve stem 842 as illustrated.

When the main body 912 of coupling 910 is advanced downward over discharge nipple 840, the tubulet 818 penetrates the nipple bore 960 forcing valve member 842 downward, compressing spring 858 to the extent that opening 848 of valve member 842 enters the main body chamber 831 of valve 817 as seen in FIG. 31B, thereby providing a fluid path through the valve member 842 and tubulet 818 into accessory solution tube 820 (FIG. 30) and on to a spray mechanism 900 (FIG. 30) located, at the hose end 902 (FIG. 30) in which an accessory cleaning tool (not shown) is removably attached. O-rings 854 sealingly engage nipple 840 and the main body 912 of coupling 910.

A typical on-off trigger operated valve 904 (FIG. 30) is provided to control the amount of solution dispensed. Further details of the valve are disclosed in U.S. Pat. No. 5,870,798; the disclosure of which is incorporated by reference. The pump 152 pressurizes cleaning solution from the solution tank 76 through the reservoir 568. Pressurized cleaning solution is supplied to valve 904 via supply tube 820 connected to the pump discharge valve 817 by quick disconnect coupling 910. The solution pump 152 typically supplies the cleaning solution at a pressure of at least 7 psig.

Referring to FIG. 29, the suction conduit 824 of the hose connector assembly 816 has a bevel outlet end 906, which slopes forwardly and downwardly, so that bottom wall 908 of the suction conduit 824 extends forwardly beyond top wall 914 of suction conduit 824. The width of the bottom wall 908 is generally slightly less than the interior width of the main recovery duct 304. Thus, as seen in FIG. 14A, when the hose connector assembly 816 is inserted into the accessory duct 786, the bottom wall 908 extends across the interior of the main recovery duct 304, thereby blocking or substantially blocking the suction from the suction motor 90 through the flowpath of the portion of the main recovery duct 304 below the accessory duct 786, floor recovery hose 228, floor recovery duct 222 and floor suction nozzle assembly 174, and hence shutting or substantially shutting off suction through the flowpath to the floor suction nozzle assembly 174. Yet, in this position, suction is created in the flowpath through the accessory duct 786, and accessory hose assembly 792 via outlet end 906. Thus, suction generated by the motor draws dirt and liquid through the accessory tool (not shown), suction hose 822, suction conduit 824, accessory duct 786, the portion of the main recovery duct 304 above the accessory duct 786, and into the recovery tank 80 as seen by the arrows.

The hose connector assembly 816 is releasably connected to the right half shell 294R as seen in FIG. 14A. Specifically, as best depicted in FIG. 29, the hose connector assembly 816 includes a collar 916 secured around base 918 of the hose connector assembly 816, located adjacent the suction hose 822. For ease of assembly, the collar 916 is cut or split open, defining an elastic c-shaped clip, which allows a user to pull the free ends apart a distance larger than the diameter of the base 918 to fit it around the base 918. After the user releases the pulling force on the collar, the elastic force of collar 916 urges the free ends toward each other to form a tight fit of the collar 916 around the base 918. Integrally molded to the collar 916, is a pair of opposite tangs 920 that extend forwardly and include hooks 922 integrally molded at the distal or free ends of the tangs 920. The tangs 920 are received in notches formed in a flange 924, which is integrally molded around the solution and suction conduits 826, 824 of the hose connector assembly 816. The tangs 920 are mounted by screws 928 to respective bosses 926, integrally molded on the suction conduit 824 and located rearwardly adjacent the flange 924. The flange 924 is positioned along the tangs 920 in close proximity to the hooks 922 such that pushing the tangs 920 inwardly flexes the hooks 922 outwardly.

When the hose connector assembly 816 is fluidly connected to the accessory duct 786 and solution discharge valve 817 as depicted in 14A, the hooks 922 extend through respective upper and lower slots 811, 814 (FIG. 10) formed in the rear side 788 of the right half shell 294R and engage the inner surface of the rear side 788. The elastic force in the elastomeric seal 812 urges the hooks 922 against the inner surface maintaining their engagement with it, thereby retaining the hose connector assembly 816 to the right half shell 294R and in fluid communication with the accessory duct 786 and solution discharge valve 817. To disconnect the hose connector assembly 816 from the right half shell 294R, a user squeezes the tangs 920, which flexes the hooks 922 outwardly and disengages them from the inner surface of the rear side 788 of the right half shell 294R, and then pulls the hose connector assembly 816 rearwardly with sufficient force to remove the solution conduit 826 from the solution discharge valve 817 and the suction conduit 824 from the accessory duct 786.

The hose connector assembly 816 provides a single connection for both the suction hose 822 and the solution tube 820 to their respective accessory duct and cleaning solution discharge valve 817 of the handle assembly 62. Such a single one-step connection results in a quick and convenient way for the user to connect the suction hose 822 and the solution tube 820 of the accessory hose assembly 792 to the handle assembly 62 for above the floor or upholstery cleaning.

The accessory hose assembly 792 fits around a hose and tool caddy 930 that is removably mounted to the rear side of the spine 292 as seen in FIG. 11. In particular, the tool caddy 930 comprises a body 932 having a pair of downward extending posts 934 integrally molded to the bottom of the body 932 and received in pockets 974 of a holder 976 (FIG. 10) integrally molded to the rear leg 298 of the spine 292, when the caddy is mounted to the handle assembly 62. An oval shaped hose support wall 936, integrally molded with the body 932, extends rearwardly from the rear side of the caddy 930 for supporting the accessory hose assembly 792 would therearound. The support wall defines u-shaped channel 938 (FIG. 1) that receives the accessory hose 792. The width of channel 938 is sized to receive two portions of the accessory suction hose 822 positioned side by side, resulting from the hose assembly 792 being wound around the hose support wall 936 twice. The bottom portion 940 of the support wall 936 extends rearwardly a distance further than the remaining portion of the support wall 936 to accommodate three portions of the accessory suction hose 822.

As best seen in FIG. 10, the body 932 includes a channel 938 formed in the rear side 942 adjacent the left portion of the support wall 936. The channel 938 receives the hose connector assembly 816 as depicted in FIG. 11. The flange 924 of the hose connector assembly 816 seats into a recessed portion 944 (FIG. 10) formed in the rear side of the body, when the hose connector assembly 816 is mounted to the caddy. A slot 946 (FIG. 10), formed in the recessed portion 944, receives a hook 948, integrally molded to flange 924 and depending downwardly (or rearwardly when the hose connector assembly 816 is connected to the handle assembly 62), to retain the hose connector assembly 816 to the caddy 930 as best seen in FIG. 30. A cut out 950 is formed in the support wall 936, so that the hose connector assembly 816 can be positioned in the channel 938.

A hook 952 (FIG. 30) is also integrally formed with the hose end 902 for retaining the hose end 902 to the caddy 930, after the accessory hose assembly 792 is wound therearound. The hook 952 extends through a slot 954 (FIG. 10) formed in a rear upstanding flange 956 of the support wall 936 and engages the front surface of the flange 956 to retain the hose end 902 to the flange 956 as seen in FIG. 30. A pair of guide rails 957 (FIG. 10) receive a bracket 958 (FIG. 30) supporting the spray mechanism 900 to hold the hose end 902 in place, keeping it straight as seen in FIGS. 11 and 30. As depicted in FIG. 10, the body 932 of the caddy includes a cross shaped projection 960 that receives the suction conduit of an upholstery accessory tool (not shown) and a pair of pockets 962 that receive opposite side corners of the tool to retain the tool to the caddy 930.

Upper and lower cord holders 964, 966 (FIG. 11) are attached to the flange 956 of the caddy 930 for receiving the electric cord wrapped around them. Upper and lower cord holders 978, 980 are also attached to the rear leg 298, thereby giving the user two places to wrap the cord. A central opening 968 is formed in the caddy for access to the inlet 790 of the accessory duct 304 and solution discharge valve 368 by the hose connector assembly 816 as well as the lower cord holder 980. A slot 970 is formed in the upper end of the opening and slidably receives a hook 972 integrally formed on the rear surface 788 of the left half shell 294L. The caddy 930 is mounted to the handle assembly 62 by sliding the slot 970 on the hook 972 and the posts 934 in the pockets 974. To remove the caddy from the handle assembly 62, a user then pulls the caddy 930 upwardly and outwardly to slide the slot 970 off the hook 972 and the posts 934 out of the pockets 974.

As seen in FIG. 11, the curvature of the upper handle portion 252 and the overall design of the caddy and lower handle body 254 allows the upper handle portion 252 to fit into the caddy and abut or be in close proximity to the body 932 thereby providing a compact, sleek appearance, when the upper handle portion 252 is folded completely down.

In use, the carpet extractor distributes the cleaning solution upon squeezing of the trigger or slide button as it substantially and simultaneously extracts it along with the dirt on the carpet in a continuous operation. Optionally, the carpet extractor can be self-propelled. The benefits of the tanks being positioned on opposite sides of the handle include the convenience of removing the tanks without moving to the front and bending over to do so, and having the handle positioned in the inclined position to remove the tanks. Also, the manipulative effort of the base assembly is improved, since the weight of recovery tank is off the base assembly. Further, the operator can better see the solution level in the recovery and solution tanks. The solution and recovery tanks 76, 80 including their outer walls 488, 320, lids 760, 324, handles 490, 326, and tabs 772, 458 also have a pleasing symmetrical outer appearance when mounted to the handle assembly 62.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto.

In view of the above, it is intended that the present invention not be limited by the preceding disclosure of the embodiments, but rather be limited only by the appended claims.

What is claimed is:

1. A cleaning apparatus for cleaning a surface in which cleaning solution is dispensed to the surface and substantially simultaneously extracted along with the dirt on the surface in a continuous operation comprising:

a) a housing;

c) a solution tank for supplying a flow of cleaning solution to the surface, said solution tank being removably mounted to said housing;

d) a recovery tank removably mounted to said housing;

e) a suction nozzle secured to said housing and in fluid communication with said recovery tank;

f) a suction source in fluid communication with said suction nozzle for generating suction to draw dirt and liquid through said suction nozzle and into said recovery tank; and g) a first latch operatively connected to said solution tank to releasably latch said solution tank from said housing, a second latch operatively connected to said recovery tank to releasably latch said recovery tank to said housing, wherein said second latch is in close proximity to said first latch.

2. The cleaning apparatus of claim 1 wherein said second is adjacent to said first latch.

3. The cleaning apparatus of claim 1 wherein said housing comprises a base portion and a handle pivotally connected to said base portion.

4. The cleaning apparatus of claim 3 wherein said solution tank and said recovery tank are removably mounted on said handle.

5. The cleaning apparatus of claim 1 wherein said first latch has an actuating portion for engagement by a user to selectively unlatch said solution tank from said housing.

6. The cleaning apparatus of claim 5 wherein said second latch has an actuating portion for engagement by a user to selectively unlatch said recovery tank from said housing.

7. The cleaning apparatus of claim 6 including a partition separating said actuating portion of said first latch from said actuating portion of said second latch to prevent inadvertent actuation of both of said actuating portions upon a user actuating one of said actuating portions.

8. The cleaning apparatus of claim 7 wherein said partition defines an actuator operatively connected to said first and second latches for engagement by a user to selectively simultaneously unlatch both of said recovery tank and said solution tank from said housing.

9. The cleaning apparatus of claim 8 wherein said actuator includes a first part secured to said actuating portion of said first latch and a second part secured to said actuating portion of said second latch.

10. The cleaning apparatus of claim 6 wherein said actuating portions together define a circular shaped.

11. The cleaning apparatus of claim 6 wherein said actuating portions are push buttons.

12. A cleaning apparatus for cleaning a surface in which cleaning solution is dispensed to the surface and substantially simultaneously extracted along with the dirt on the surface in a continuous operation comprising:

a) a housing;

c) a solution tank for supplying a flow of cleaning solution to the surface, said solution tank being removably mounted to said housing;

d) a recovery tank removably mounted to said housing;

e) a suction nozzle secured to said housing and in fluid communication with said recovery tank;

f) a suction source in fluid communication with said suction nozzle for generating suction to draw dirt and liquid through said suction nozzle and into said recovery tank;

g) a latching assembly operatively connected to said solution tank and said recovery tank to releasably latch said tanks to said housing; and h) an actuator operatively connected to said latch assembly for engagement by a user to selectively simultaneously unlatch both of said recovery tank and said solution tank from said housing.

13. The cleaning apparatus of claim 12 wherein said housing comprises a base portion and a handle pivotally connected to said base portion.

14. A cleaning apparatus for cleaning a surface in which cleaning solution is dispensed to the surface and substantially simultaneously extracted along with the dirt on the surface in a continuous operation comprising:

a) a housing, said housing having a front portion, a rear portion, and a pair of opposite side portions;

b) said housing including a base portion for movement along the surface and a handle pivotally connected to said base portion;

c) a solution tank for supplying a flow of cleaning solution to the surface removably mounted to one of said side portions;

d) a recovery tank removably mounted to other one of said side portions;

e) a suction nozzle secured to said base portion and in fluid communication with said recovery tank;

f) a suction source in fluid communication with said suction nozzle for generating suction to draw dirt and liquid through said suction nozzle and into said recovery tank; and g) a latch assembly operatively connected to said housing and one of said solution and said recovery tank for releasably latching said tank to said housing, said latch assembly being positioned between said recovery and solution tanks.

15. The cleaning apparatus of claim 14 wherein said latch assembly comprises a first latch operatively connected to said solution tank to releasably latch said solution tank to said housing, a second latch operatively connected to said recovery tank to releasably latch said recovery tank to said housing, said second latch being in close proximity to said first latch.

16. The cleaning apparatus of claim 15 wherein said second latch is adjacent to said first latch.

17. The cleaning apparatus of claim 15 wherein said first latch has an actuating portion for engagement by a user to selectively unlatch said solution tank from said housing, said second latch has an actuating portion for engagement by a user to selectively unlatch said recovery tank from said housing.

18. The cleaning apparatus of claim 17 wherein said actuating portions are push buttons.

19. The cleaning apparatus of claim 15 including a partition separating said actuating portion of said first latch from said actuating portion of said second latch to prevent inadvertent actuation of both of said actuating portions.

* * * * *